US007698835B2

(12) United States Patent
Potter et al.

(10) Patent No.: US 7,698,835 B2
(45) **Date of Patent: *Apr. 20, 2010**

(54) FOOTWEAR WITH A BLADDER TYPE STABILIZER

(75) Inventors: Daniel R. Potter, Beaverton, OR (US); Lorrie G. Vogel, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/341,174

(22) Filed: Dec. 22, 2008

(65) Prior Publication Data

US 2009/0100710 A1 Apr. 23, 2009

Related U.S. Application Data

(60) Continuation of application No. 11/055,158, filed on Feb. 10, 2005, now Pat. No. 7,472,496, which is a division of application No. 09/960,627, filed on Sep. 21, 2001, now Pat. No. 6,871,421.

(51) Int. Cl.
*A43B 7/14* (2006.01)
*A43B 13/20* (2006.01)

(52) U.S. Cl. ..... 36/88; 36/93; 36/50.1; 36/29

(58) Field of Classification Search ..... 36/88, 36/93, 29, 50.1, 10, 55
See application file for complete search history.

(56) References Cited

U.S. PATENT DOCUMENTS

| | | | |
|---|---|---|---|
| 1,976,656 | A | 10/1934 | Clark |
| 4,361,969 | A | 12/1982 | Vermont |
| 4,670,995 | A | 6/1987 | Huang |
| 4,722,131 | A | 2/1988 | Huang |
| 4,744,157 | A | 5/1988 | Dubner |
| 4,813,158 | A | 3/1989 | Brown |
| 4,991,317 | A | 2/1991 | Lakic |
| 5,025,575 | A | 6/1991 | Lakic |
| 5,060,401 | A | 10/1991 | Whatley |
| 5,113,599 | A | 5/1992 | Cohen et al. |
| 5,193,246 | A | 3/1993 | Huang |
| 5,253,435 | A | 10/1993 | Auger et al. |
| 5,355,552 | A | 10/1994 | Huang |
| 5,425,184 | A | 6/1995 | Lyden et al. |
| 5,444,926 | A | 8/1995 | Allen et al. |
| 5,595,004 | A | 1/1997 | Lyden et al. |
| 5,617,650 | A | 4/1997 | Grim |
| D380,290 | S | 7/1997 | Nakagawa |

(Continued)

FOREIGN PATENT DOCUMENTS

| | | |
|---|---|---|
| FR | 2614510 | 11/1988 |
| WO | WO 9110376 | 7/1991 |

*Primary Examiner*—Marie Patterson
(74) *Attorney, Agent, or Firm*—Banner & Witcoff, Ltd.

(57) ABSTRACT

A stability device that increases foot security on the footbed of a shoe, provides lateral or medial stability, shock dampening, and optimizes flexibility. The stability device includes a resilient bladder insert having a horizontal sole portion underneath a wearer's foot, and a foot portion positioned along a lateral or medial side edge of a wearer's foot. The sole portion and the foot portion are in fluid communication. The stability device can be generally L-shaped to cradle a portion of the foot. The stability device can also include a plurality of finger-shaped elements that encircle the top of the foot and expand down onto the foot due to an increase in fluid pressure therein.

15 Claims, 16 Drawing Sheets

U.S. PATENT DOCUMENTS

| | | | | |
|---|---|---|---|---|
| 5,669,161 | A | 9/1997 | Huang | |
| 5,692,321 | A | 12/1997 | Holstine | |
| 5,784,807 | A | 7/1998 | Pagel | |
| 5,830,553 | A | 11/1998 | Huang | |
| 5,902,660 | A | 5/1999 | Huang | |
| 5,987,779 | A | 11/1999 | Litchfield et al. | |
| 6,128,837 | A | 10/2000 | Huang | |
| 6,161,240 | A | 12/2000 | Huang | |
| 6,170,173 | B1 | 1/2001 | Caston | |
| 6,195,914 | B1 | 3/2001 | Otis | |
| 6,298,499 | B1 | 10/2001 | Huang | |
| 6,428,865 | B1 | 8/2002 | Huang | |
| 6,785,985 | B2 | 9/2004 | Marvin | |
| 6,865,825 | B2 | 3/2005 | Bailey et al. | |
| 7,472,496 | B2 * | 1/2009 | Potter et al. | 36/88 |
| 2002/0189135 | A1 | 12/2002 | Hanks | |
| 2005/0132606 | A1 | 6/2005 | Passke et al. | |
| 2006/0130369 | A1 | 6/2006 | Christensen et al. | |

* cited by examiner

FOOTWEAR WITH A BLADDER TYPE STABILIZER

CROSS-REFERENCE TO RELATED APPLICATION

This non-provisional U.S. patent application is a continuation application and claims priority to U.S. patent application Ser. No. 11/055,158, which was filed in the U.S. Patent and Trademark Office on Feb. 10, 2005 now U.S. Pat. No. 7,472,496, which said application is a divisional application of and claims priority to U.S. patent application Ser. No. 09/960,627, which was filed in the U.S. Patent and Trademark Office on Sep. 21, 2001, now U.S. Pat. No. 6,871,421, issued Mar. 29, 2005, and entitled Footwear With A Bladder Type Stabilizer, such prior U.S. patent applications being entirely incorporated herein by reference.

BACKGROUND OF THE INVENTION

1. Field of the Invention

This invention pertains to a cushioning system for footwear that enhances dynamic stability. More particularly, this invention pertains to compressible and expandable bladders extending along a portion of the sole and wrapping upward to embrace a portion of the foot for dynamically providing foot stability upon loading in shoes.

2. Description of Background Art

Shoe design reflects a highly refined combination of elements that cooperatively interact to minimize shoe weight while maximizing comfort, cushioning, stability and durability. However, these objectives must be balanced to avoid potential conflict with each other. Efforts to achieve one of the objectives can have deleterious effect on one or more of the others. As a result, the shoe industry has invested significantly in the study of human anatomy and biomechanics in its continuing efforts to optimize these competing objectives. Efforts have in a large part been directed at optimizing qualities of cushioning and stability.

Athletic shoes are of particular interest because they are subject to repetitive compression with high loads associated from running or jumping, which ultimately deteriorate the shoe materials. Yet, over the life of the shoe, the shoe must continue to provide cushioning and stability. Stability is the objective that is concerned with maintaining a wearer's foot in a fixed position within the shoe and preventing the shoe from rolling over a lateral or medial side edge of the shoe. Maintaining stability for the duration of the shoe is particularly important for preserving a healthy foot.

Shoe designs that focus on optimizing stability ultimately reduce risks of injury. A common such injury is sideways (i.e., lateral or medial) foot rotation. Sports such as basketball, tennis, indoor and outdoor soccer, rugby, lacrosse, and football as well as a wide range of other activities require frequent and quick lateral bodily movements. A secure foot plant becomes essential to the movement of the upper portion of the body. Injury often occurs when the foot plant is not secure and stable. For example, a significant ankle injury can occur when the foot rotates sideways over the edge of a shoe. This sideways rotation can over-extend any inherent flexibility of the ankle joint. Rotation of the foot outward towards a lateral side of the foot can result in pulled tendons or a sprained or broken ankle, and foot rotation inward toward a medial side of the foot can have like detrimental consequences.

A shoe typically comprises a multiple part construction. Generally, a shoe may be divided into four sections. An "outsole", often called a "ground engaging surface," is located on the bottom of a shoe. An "upper" is the top portion of the shoe that encircles or envelopes a user's foot. Inside of the upper can be an insole, which is typically a pad-like member directly under a user's foot. Finally, there is a "midsole" positioned between the outsole and the upper. A footbed for a wearer's foot to rest on can be either the top surface of the insole or a top surface of the midsole.

The outsole is generally formed of a durable material for resisting wear during use; typically the material is rubber or a rubber-like composite. The material selections for the upper are numerous, for example, leather, polymers, a variety of natural or synthetic webs or meshes, and materials that are breathable, water resistant, water repellant may be chosen for their appearance and/or performance.

The midsole that forms a middle surface of the shoe is typically comprised of cushioning material. The cushioning material traditionally included polyurethane or ethylene vinyl acetate ("EVA") foam. However, from about 1970, manufacturers began focusing their attention upon enhancing the midsole cushioning in shoes, especially for athletic shoes. These types of shoes are subject to intense compressions in addition to a greater numbers of compression cycles over the life of the shoe. The use of resilient bladders combined with traditional cushioning materials represented a marked improvement in midsole design. In particular, the use of resilient, inflated bladder midsole inserts, e.g., in accordance with the teachings of U.S. Pat. Nos. 4,183,156, 4,219,945, and 4,340,626 to Rudy, provided longevity to the midsole cushioning. The industry's focus on improving cushioning greatly advanced the state of the art in shoe design. In some cases, however, the benefits realized by cushioning were offset by a degradation of side-to-side shoe stability in response to lateral or medial movements and loads.

U.S. Pat. No. 5,425,184 to Lyden et al., discusses shoe progression and, in particular, evolutionary increases in midsole height. Shoe midsoles have increased in thickness largely to address the cushioning aspect of shoe design. These height increases have causes some stability problems. Lyden'184 addresses a height problem in the heel region where the forward foot motion from a heel strike advancing to a toe push off is rotated with an undesirable velocity due to the larger height of the heel region creating a lever arm and a greater moment propelling the foot forward.

The increase in midsole thickness creates a specific stability problem in activities where frequent and firm foot plants and quick lateral bodily movements are common. Specifically, the problem is that there is a tendency for detrimental sideways foot rotation over a side edge of the shoe.

Foot rotation in the sideways direction can be envisioned by picturing foot rotation about an imaginary line that extends generally longitudinally for the length of the foot, from the middle of the ankle to the middle of the toes. The tendency for rotation of the foot about this line is accentuated by increasing the distance between the bottom of the foot and the ground surface. Foot rotation about this longitudinal line, and consequently foot rotation sideways over the edge of the shoe, is most commonly and most dramatically noted in high-heeled women's shoes. Sideways rolling-over is due in part to the great distance between the foot and ground. The greater the distance, the easier it is to rotate sideways over the edge of the shoe. While most athletic shoes do not reach the height of women's high-heeled shoes, the lateral stability demand of athletic shoes is just as great if not greater. Lateral stability is essential for frequent and firm foot plants and quick lateral bodily movements necessary in sports.

What is needed is a stability device that prevents undesirable sideways foot rotation, increases security of the foot within the shoe, and facilitates keeping the foot in position on the footbed of the shoe, yet remains flexible and cushions the foot.

SUMMARY OF THE INVENTION

The inventive dynamic lateral stability device provides cushioning via a resilient, fluid filled bladder. The bladder is structurally shaped to provide dynamic stability to a lateral or medial side edge of a foot by rapidly shifting fluid and increasing fluid pressure in response to rapid changes in compression loading on the bladder. The resilient bladder along with other elements of the invention are structured to provide lateral and medial stability, improve positional contact of the wearer's foot with the footbed and provide cushioning, all while optimizing flexibility.

Structurally, the dynamic lateral stability device of the present invention comprises a resilient bladder insert for footwear which is generally situated adjacent a lateral or medial side edge of the foot. In one embodiment, the device includes a generally L-shaped bladder, which cradles a portion of the foot. The device is particularly suited for cradling a metatarsal region of the foot, specifically a tip the fifth metatarsal head on the lateral side of the foot or the first metatarsal head on the medial side of the foot, or both. The device includes a horizontal sole portion located generally underneath the foot and a vertical foot portion located adjacent to a lateral or medial side edge of the foot. The vertical foot portion functions as a bumper-like lateral sidewall that varies in degrees of stiffness with loading and unloading of the horizontal sole portion. As the load increases on the horizontal sole portion, the vertical foot portion becomes increasingly stiffer. When the side edge of the wearer's foot directly or indirectly contacts the vertical foot portion, the bumper-like sidewall absorbs lateral impacting forces and aids in preventing the foot from rolling over the edge of the shoe.

The horizontal sole portion of the bladder is preferably thicker than the vertical foot portion to provide a thicker bladder for cushioning underneath the wearer's foot. By contrast, a thinner vertical foot portion of the bladder is structurally firmer for providing lateral stability to a side of the foot even when un-pressurized by compression loading. The volume of the horizontal sole portion, however, is not unduly large with respect to the vertical foot portion. Providing a small volume of the horizontal sole portion and/or a small ratio of volumes between the horizontal sole portion and the vertical sole portion helps ensure that pressure due to compression of the horizontal sole portion is transferred to the vertical foot portion and not dissipated within the horizontal sole portion.

The resilient bladder of the dynamic lateral stability device may include at least one channel and/or contact in the horizontal sole portion for reducing the volume of the horizontal sole portion. Similarly, the vertical foot portion may include at least one channel and/or contact for reducing its volume. The channels improve heel-to-toe transitioning and overall flexibility of the resilient bladder. The contacts impart structural integrity to the bladder. The contact may be a weld, an oval shaped weld, and/or include through-holes for breathability to permit air, vapor and moisture to pass through the device.

In some of the embodiments, the dynamic lateral stability device has a means for compensating for an increase in internal volume of the shoe, due to a compression of a sole assembly by the wearer's foot, by substantially simultaneously decreasing the internal volume toward its original snug fit. The compensating means may include a tightening means including a vertical foot portion of the resilient bladder. The vertical foot portion may comprise a plurality of protrusions which can have various forms including finger-shaped elements. The finger-shaped elements support a lateral or medial side edge of a foot, and can cradle one or both sides of the wearer's foot and/or can encircle the top of a wearer's foot. The finger-shaped elements can expand and contract in response to an increase in fluid pressure to affect the internal volume of the shoe.

In some embodiments, the dynamic lateral stability device including a means for compensating, and means for tightening has a vertical foot portion that comprises a plurality of protrusions or finger-shaped elements which may expand creating a counter-force for pushing on or toward the foot for returning the foot to a safe, non-injurious position and preventing the foot from rolling-over. When the vertical foot portion increases in pressure and dynamically expands in response to loading of the horizontal sole portion: 1) the vertical foot portion becomes stiffer due to an increase in pressure, forming a bumper-like wall for absorbing sudden and impacting lateral or medial forces; 2) a counter-force is created by the expanding vertical foot portion for pushing the foot back onto the footbed; 3) the volume of the shoe decreases by the expanding vertical foot portion further helping to hold the foot on the footbed; and 4) the vertical foot portion contracts in select directions serving to tighten the upper by bringing the upper closer to the footbed further securing the foot on the footbed. Expansion of the foot portion is most important in the embodiments having finger-shaped elements because expansion of the finger-shaped elements tends to have a greater tightening affect due to contraction in the length of the finger-shaped elements and reduction of volume of the shoe.

The finger-shaped elements can be structured to have a bulbous section and a stem section, where the bulbous section expands outwards shortening the overall length of the finger. The compensating means and tightening means may further include finger-shaped elements that are attached to straps or other upper materials that are substantially inelastic in a lateral direction with respect to the shoe. When the finger-shaped elements contract in length due to loading, the straps and/or upper material is pulled tight on the wearer's foot, which tends to hold the foot on the footbed. In another embodiment, the finger-shaped elements may encircle a wearer's foot such that expansion of the finger-shaped elements takes up an appreciable volume of the shoe, which as mentioned earlier, tends to hold the foot on the footbed.

Since the dynamic lateral stability device comprises a gas filled bladder, the overall weight of the shoe can be reduced as compared to a shoe having a solid foam midsole, for example. Further, the bladder may be made of a material that permits selective portions to be transparent or translucent for enhancing the appearance of lightness and overall aesthetic appeal of the shoe. The device may include additional cushioning pads for cushioning the sole of the foot and for providing linking structure for an assembly that extends from one side of the foot to the other. Additionally, the device may include at least one horizontal sole portion and two vertical foot portions to form a U-shaped bladder for support of both sides of a wearer's foot.

Other objects and advantages of the invention will be more fully understood from the following detailed description and appended claims when taken with the accompanying drawings.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
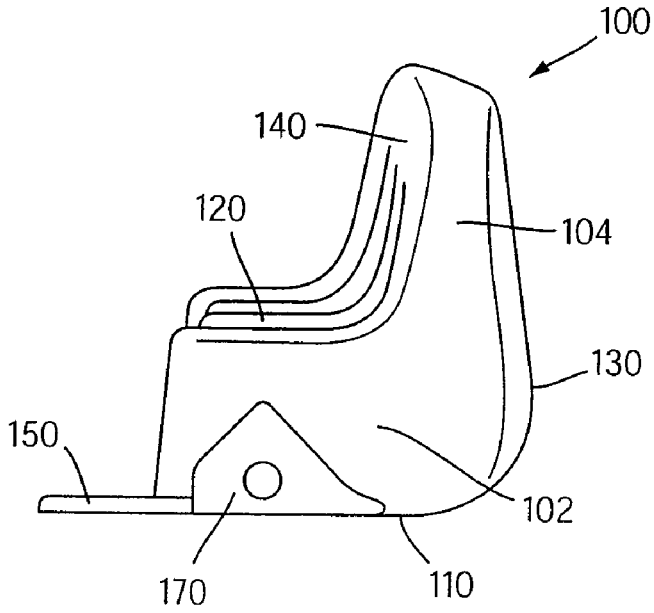
FIG. 1 is an end view of an embodiment of the resilient bladder insert of the dynamic lateral stability device.

Broadly, the present invention provides a dynamic lateral stability device that moderates high lateral compressive loads and improves stability by helping to ensure that the bottom of a wearer's foot stays substantially in contact with the footbed. The device may comprise a resilient bladder insert having a horizontal sole portion and an upstanding or vertical foot portion which extends upward along a side of a shoe proximal a portion of the lateral or medial side edge of the foot. When a compressive load is applied to the horizontal sole portion, the horizontal sole portion compresses causing an increase in fluid pressure in the bladder insert because the overall volume of the bladder is decreased by the compression yet the volume of fluid remained constant. The increase in fluid pressure causes the vertical foot portion of the bladder to stiffen and in some embodiments to expand. The lateral stability device may also include one or more straps or a vamp that is substantially inelastic in one direction and connected to the resilient insert.

The dynamic stability aspect of the invention for helping to prevent the foot from rolling over is attributed largely to the dynamic stiffening of the vertical foot portion. An increasingly stiffer bumper-like wall is created as compression loads increase on the horizontal sole portion of the device. The cushioning aspect of the device dampens and absorbs the shock of compressive loads both on the horizontal sole portion and the vertical foot portion of the device. As further explained, the dynamic lateral stability device is able to provide cushioning and stability in response to instantaneous changes of the wearer's foot motions during quick athletic movements.

Referring now to the embodiment of FIGS. 1-6, the inventive dynamic lateral stability device is shown as including a resilient bladder insert 100. Resilient bladder insert 100 is comprised of a first portion 102 and a second portion 104 that is generally at a right angle to the first portion. First portion 102 is a horizontal sole portion that underlies a portion of a wearer's foot, and second portion 104 is a vertical foot portion that extends upward along a side edge of a foot. In combination, the horizontal sole portion and the vertical foot portion define a generally L-shaped device. Horizontal sole portion 102 and vertical foot portion 104 are in fluid communication such that compression of horizontal sole portion 102 causes fluid therein to transfer to vertical foot portion 104. Fluid transfer from horizontal sole portion 102 to vertical foot portion 104 increases the fluid pressure in vertical foot portion 104 causing vertical foot portion 104 to become stiff and more rigid, and in some cases expand. The degree of stiffness of vertical foot portion 104 increases with increasing loads on horizontal sole portion 102 defining a dynamically increasingly stiffer bumper-like wall for the side edges of a foot. When the bumper-like wall is positioned adjacent a lateral or medial side edge of a wearer's foot, the increasingly stiffer vertical foot portion 104 serves to dampen and absorb compression impacts thereby reducing the tendency of the foot to roll over the side of the shoe and concomitantly helping to maintain positional contact of the wearer's foot with the footbed of the shoe.

The resilient insert 100 of FIGS. 1-6 has a rectangular shaped sole portion 102 and a trapezoidal shaped foot portion 104 generally defined by a bottom surface 110, a top surface 120, an outside surface 130 and an inside surface 140. Bottom surface 110 forms an outside horizontal surface. Opposing the bottom surface is top surface 120 forming an inside horizontal surface. Outside surface 130 forms an outside vertical surface. And, inside surface 140 forms an inside vertical surface that opposes outside vertical surface 130 and is generally at a right angle to the inside horizontal surface.

Resilient insert 100 may include at least one channel 122 recessed in top surface 120 and extending from an edge 186 into inside vertical surface 140. Resilient insert 100 may further include at least one through channel 124 that extends from top surface 120 to a recess 125 in the bottom surface 110, see FIG. 5. Each of the channels 122 including the through channel 124 is located generally perpendicular to the inside and outside vertical surfaces imparting longitudinal flexibility and lateral rigidity to resilient insert 100. Specifically, the channels permit resilient insert 100 to flex in the longitudinal direction of the shoe, which is important for foot roll-through from a heel strike to a toe push-off. Recess 125 and the corresponding through channel 124 further provide arcuate flexibility for fitting the resilient insert to a variety of midsole contours and to a variety of sizes and shapes of footwear. The channels also impart some structural rigidity for maintaining the form of the insert through-out the useful life of the shoe.

Figure 2:
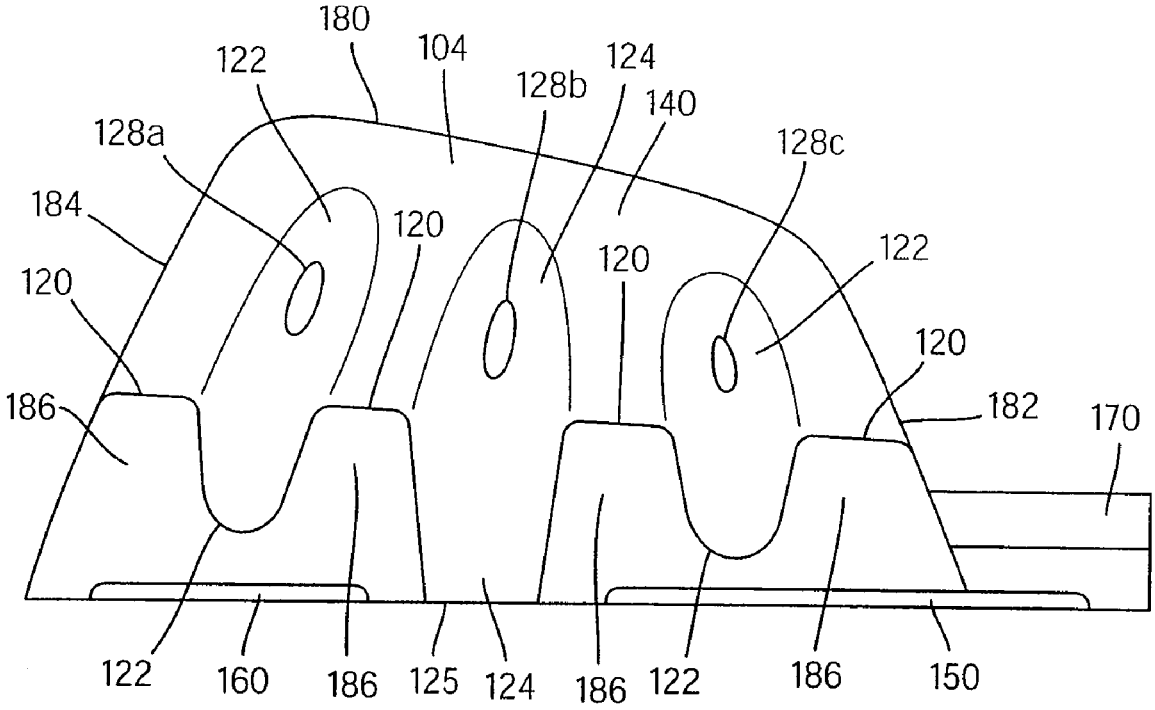
FIG. 2 is a side view of the insert of FIG. 1.
Figure 3A:
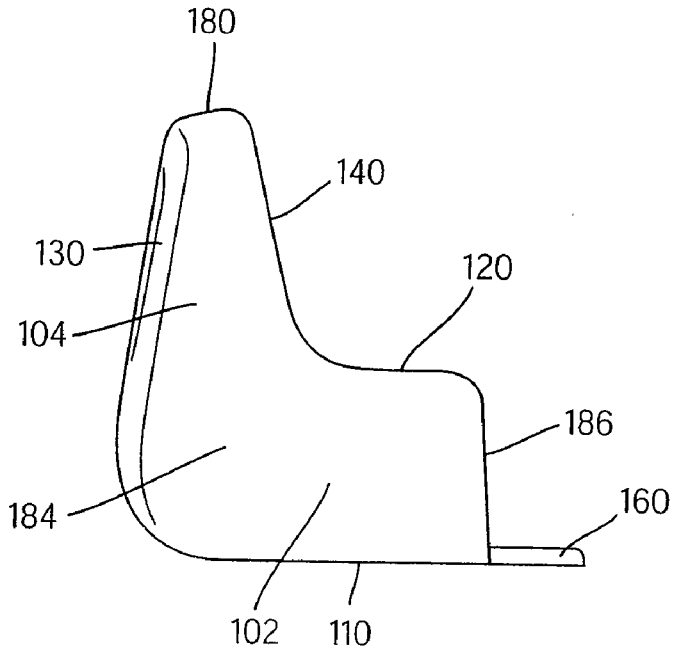
FIG. 3A is an opposing end view of the insert of FIG. 1.
Figure 4:
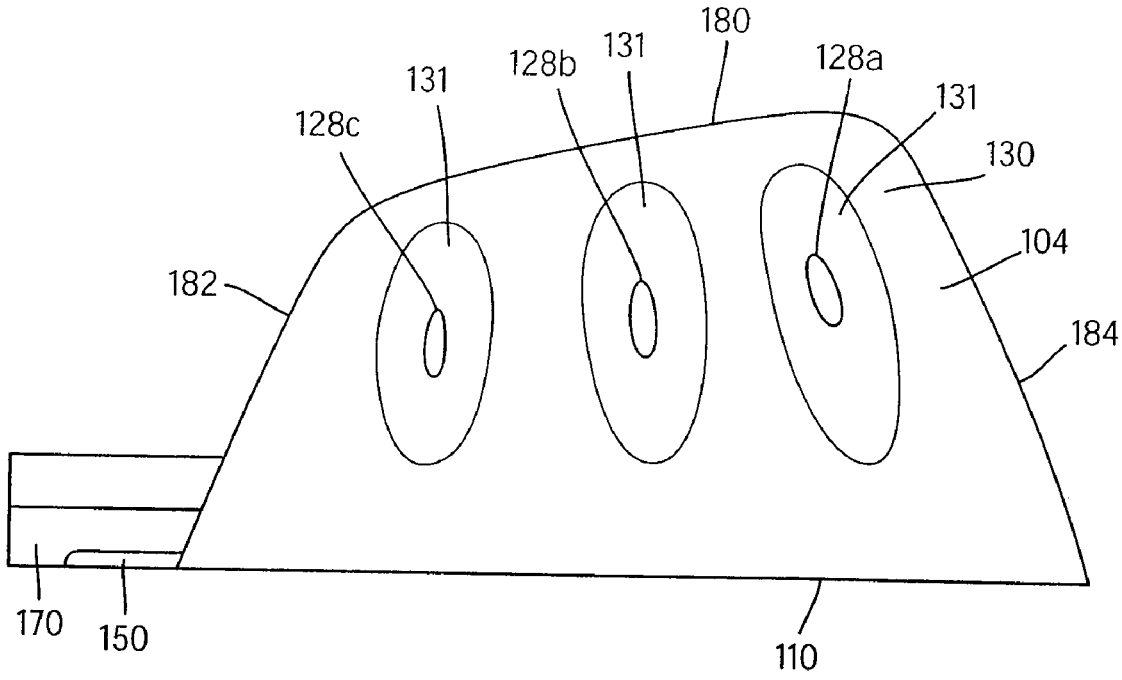
FIG. 4 is an opposing side view of the insert of FIG. 1.
Figure 3B:
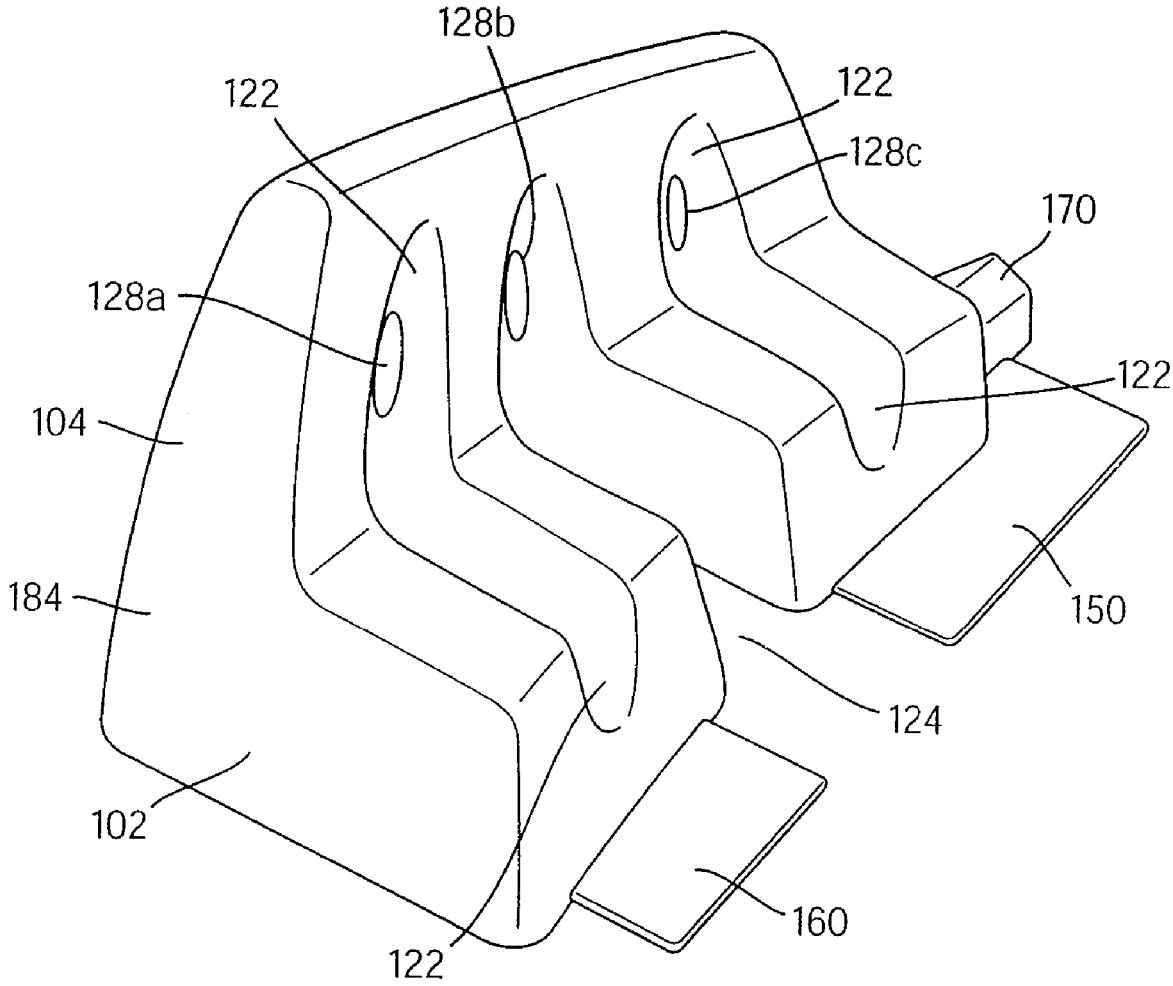
FIG. 3B is a perspective view from the end view of FIG. 3A of the insert of FIG. 1.

FIG. 2 shows channels 122 and 124 extending upward into inside vertical surface 140 and terminating before an upper edge 180 of foot portion 104. Lateral rigidity is imparted to inside vertical surface 140 by the upwardly extending channels 122 and 124, such that, foot portion 104 forms a bumper-like wall for the foot even when the sole portion 102 is not compression loaded.

Figure 5:
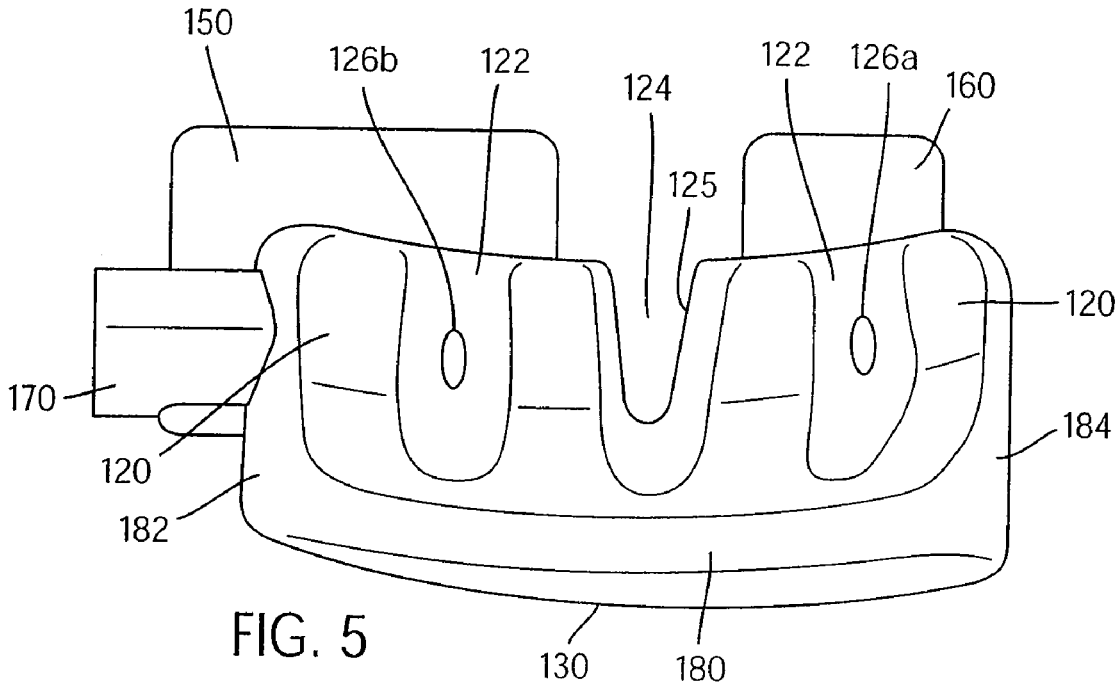
FIG. 5 is a top view of the insert of FIG. 1.

Resilient insert 100 may further include at least one contact, such as contacts 126*a* and 126*b* in channels 122, see FIG. 5. Contacts 126*a* and 126*b* are oval shaped welds, where each weld includes a portion of a channel 122 contacting bottom surface 110. Similarly, resilient insert 100 includes contacts 128*a*, 128*b* and 128*c* in the channel portions that extend into inside surface 140, see FIGS. 2 and 4. The contacts 128(*a-c*) are oval shaped welds where a portion of the channel that extends into the inside surface 140 contacts the outside surface 130. Outside surface 130 tapers inward toward inside surface 140 around the circumference of the contacts, see tapering regions 131 in FIG. 4. Each of the contacts 128(*a-c*) add structural stability to the bladder and help prevent the walls of the bladder from uncontrollably bulging. The oval shape of the contacts is believed to further enhance structural integrity and stability and prevent uncontrolled bulging of the walls.

Since resilient insert 100 of the present invention may be made from a variety of known techniques, the term "weld" is used hereafter to broadly denote an area of contact rather than a specific process. Resilient insert 100 may be made from known techniques, including but not limited to, vacuum forming, blow-molding, injection molding, cast molding, slush molding or forming from multiple sheets welded or otherwise bonded together in selected areas. In any one of the following, the weld area of contact may be formed during or after the forming process. Additionally, an aperture may extend from one surface to another where an area of contact occurs between opposing surfaces at a circumference of the aperture. An aperture of this type may be beneficial for breathability in that air, vapor and moisture are permitted to pass through the device.

Resilient bladder insert 100 may include an integral flange for connecting the resilient insert into an article of footwear. A flange 150 extends from sole portion 102 and is co-extensive with bottom surface 110, as shown best seen in FIG. 1 and FIG. 5. A second flange 160 extends from sole portion 102 and is also co-extensive with bottom surface 110. The purpose of each flange is to provide a region where resilient bladder insert 100 can be attached to a shoe, and more specifically each flange can provide a region where the resilient insert can be bonded to the midsole and/or outsole.

Adjacent flange 150 can be a nozzle 170. The nozzle 170 can be used for inflating resilient bladder insert 100 with fluid to a predetermined pressure. The bladder may be inflated with fluid during manufacturing and permanently sealed therein or the amount of fluid may be added and subtracted to change the fluid pressure with a pumping device applied to nozzle 170. The pressure range is from about 0 psi to about 50 psi (pounds per square inch). Preferably, when the resilient insert is not compression loaded, the resilient insert is under a pressure from about 0 psi to about 8 psi. In a compressed or loaded condition, the pressure increases dramatically. In a loaded condition, sole portion 102 is compressed diminishing the overall internal volume of the fluid filled insert. Since the same amount of fluid is still present in the insert, compression of sole portion 102 causes the internal fluid pressure to increase. The increase in fluid pressure causes the vertical foot portion 104 to stiffen, and may in some cases expand appreciably.

The fluid preferably is air, nitrogen, or some other gas, or a combination of thereof. The fluid can be air at ambient pressure. Alternatively, the fluid may be hexafluorethane, sulfur hexafluoroide, or other gases such as those mentioned in U.S. Pat. Nos. 4,183,156 and 4,219,945 to Rudy, which are herein incorporated by reference.

Figure 6:
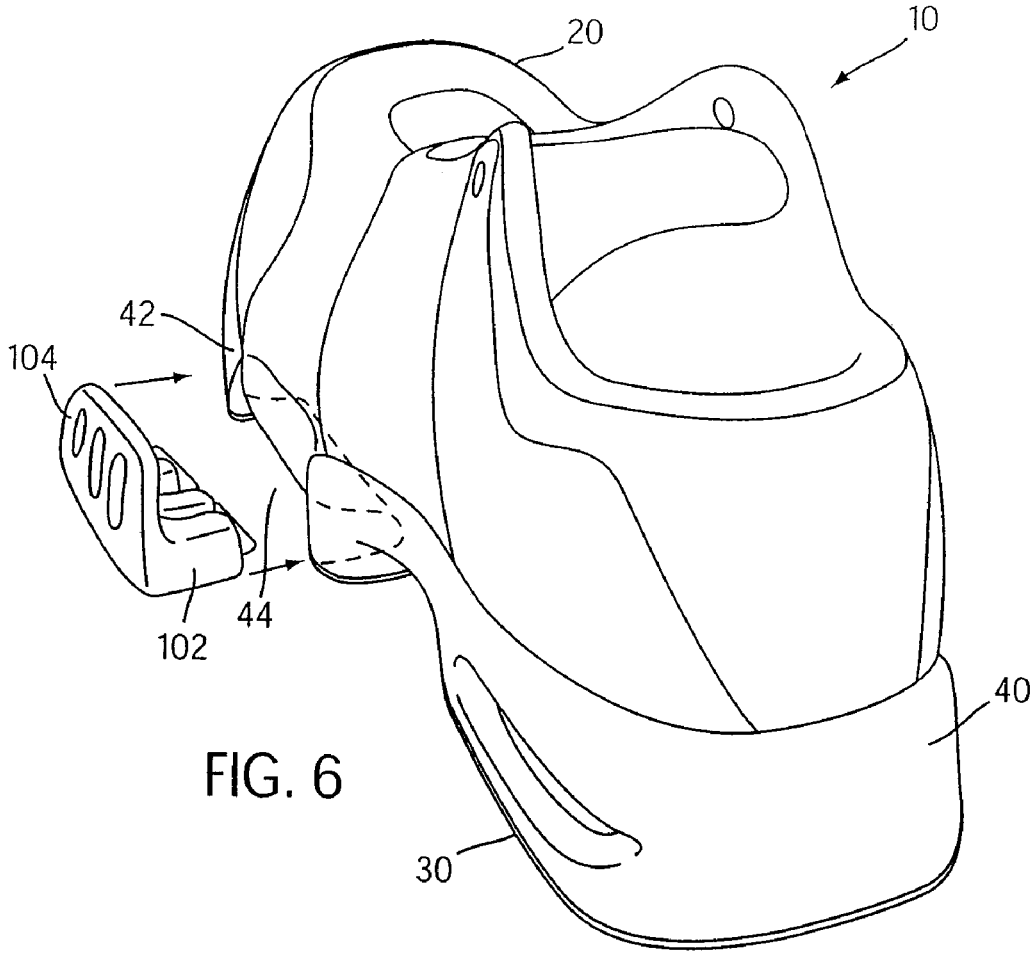
FIG. 6 is an exploded perspective view of the insert of FIG. 1 shown in an article of footwear for a left foot.

As shown in FIG. 6, resilient insert 100 may be situated in a left shoe 10 proximal a lateral edge of the foot in the metatarsal region. Sole portion 102 is located generally horizontal underneath the foot and foot portion 104 is located vertically adjacent to the lateral edge of the foot, proximal the fifth metatarsal head. Shoe 10 has an upper 20 and an outsole 30, both of which are connected to a midsole 40. A sole assembly comprising outsole 30 and midsole 40 defines an opening 44 extending into a lateral side 42. The opening in the outsole and midsole is for receipt of sole portion 102. Inside horizontal surface 120 of sole portion 102 is positioned generally flush with a contour of the midsole's top surface. Outside horizontal surface 110 of sole portion 102 is co-planar with outsole 30, such that, a portion of resilient insert 100 is visible from the bottom of the shoe. Outside vertical surface 130 of foot portion 104 is generally contiguous with an outer lateral surface of the midsole, so a portion of the insert is visible from the lateral side of the shoe.

Horizontal sole portion 102 is preferably thicker in volume than vertical foot portion 104 for providing sufficient cushioning underneath the foot while providing structural stability to a lateral or medial side edge of a foot. The volume of horizontal sole portion 102 is preferably not unduly large with respect to the volume of the vertical foot portion. Providing a small horizontal sole portion volume and/or a small ratio of horizontal sole portion to vertical foot portion volumes ensures that pressure due to compression of horizontal sole portion 102 is transferred to the vertical foot portion. If horizontal sole portion 102 is too large fluid pressure increase due to a compression force on only a small area of the horizontal sole portion may substantially dissipate within the horizontal sole portion without causing an appreciable increase in fluid pressure with the result that an insufficient increase in stiffness of the vertical foot portion occurs.

Outside vertical surface 130 may be arcuate to conform to a curvature of a lateral edge of shoe 10. As mentioned, the through channel 124 and recess 125 permit flexibility and additional curvature, which can be useful for fitting resilient insert 100 to a variety of sizes, types and shapes of footwear. The flexibility also permits a natural heel-to-toe transition by bending with the foot as the foot rolls through from a heel strike to a toe push-off.

Upper edge 180 of foot portion 104 can be contoured to the shape of the upper and/or shape of the midsole. For example, upper edge 180 shown in FIG. 2 is tapered from a rear edge 184 down to a forward edge 182. In use, the taper descends toward the toe-box generally mirroring a taper of the shoe upper.

The upper is connected to inner vertical wall 140 of resilient insert 100. In this manner, resilient insert 100 is visible from the exterior of the footwear. The upper may be connected to the insert by adhesive, or other known means of connecting. The resilient insert or portions of the insert may be made of transparent or translucent materials such that the interior three dimensional structure is visible through an insert wall. The inner vertical wall 140 is shown as arcuate for conforming to the contours of the upper or more generally conforming to a lateral side edge of the foot.

In operation, the lateral stability device as shown and described provides dynamic lateral stability and cushioning for footwear. Resilient insert 100 is positioned in a shoe such that a compression force on sole portion 102 transfers fluid from sole portion 102 to foot portion 104, which causes an increase in pressure in foot portion 104. The increase in pressure in foot portion 104 makes foot portion 104 stiffen and form an increasingly stiffer bumper-like wall. Preferably, foot portion 104 is positioned adjacent to a lateral or medial side edge of a foot, so that, when the wearer's foot collides with the bumper-like foot portion the lateral force of the foot is moderated thereby reducing the tendency of the foot to laterally or medially roll over. Additionally, the stiffened foot portion tends to prevent collapse of the shoe upper by improving structural integrity, which provides additional foot support and thus helps prevent the foot from fatiguing.

Foot portion 104 can be designed to appreciably expand by using more flexible materials or making various changes in the channels and welds. Expansion due to an increase in fluid pressure in foot portion 104 can create a counter-force that serves to push the foot back into position on the footbed of the shoe. The expansion further takes up volume inside of the shoe further helping to keep the foot on the foot bed. Maintaining the foot on the footbed of the shoe ultimately helps prevent the foot from rolling over the side of the shoe.

As discussed in the Background of the Invention, increases in midsole height leads to stability problems. The greater the distance between the ground surface and the bottom of the foot, the greater the instability. For example, walking stilts are less stable than shoes, and high-heeled shoes are less stable than athletic shoes. The greater the distance the foot is removed from the ground surface, the more likely the foot will roll over to the side of the shoe. Merely increasing the thickness of an athletic shoe midsole increases this sideways instability. Sideways roll over of the foot can occur when the foot rotates a shoe onto a side edge of the outsole and then over the edge. Sideways roll over occurs more easily (i.e., under less force) the greater the combined height of the outsole and the midsole.

The present invention diminishes roll over tendencies by functioning as described earlier. The bumper-like resilience of the bladder absorbs and dampens impacting lateral or medial forces from the foot. The lateral or medial stiffened wall also prevents distortion of the flexible upper material further helping to keep the foot on the footbed. When vertical foot portion 102 is designed to expand under pressure, a counter-force is created which serves to push the foot back onto the footbed. Expansion of vertical foot portion 104 also reduces the volume of the shoe serving to prevent the foot from floating in the shoe and further keeping the foot on the footbed. A vertical foot portion 104 having a thin inside vertical wall as compared to an outer vertical wall will tend to permit expansion toward the wearer's foot.

Figure 7:
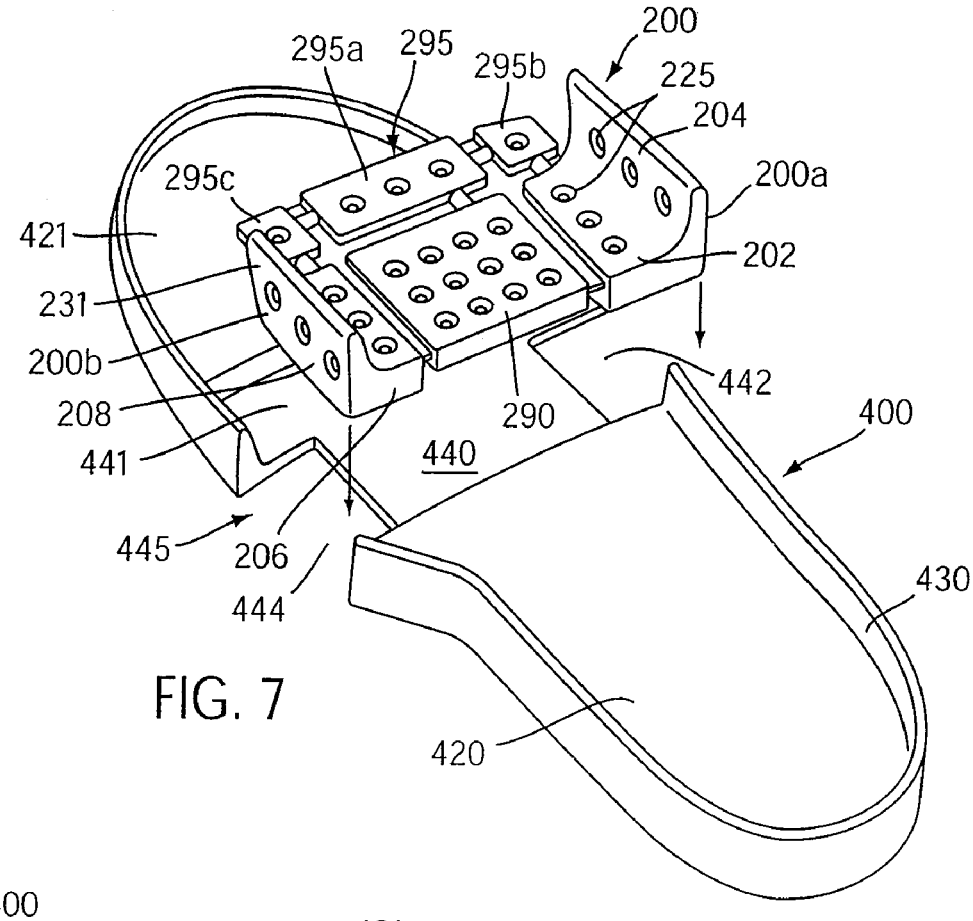
FIG. 7 is an exploded perspective view of another embodiment of the dynamic lateral stability device insert with a sole member of an article of foot wear for a right foot.

The resilient insert 100 of the dynamic lateral stability device of FIGS. 1-6 may have a sole portion 102 that is the same thickness or thinner than midsole 40. If midsole 40 is the same thickness, outsole 30 would cover and protect bottom surface 110 of the bladder from punctures. If sole portion 102 is thinner, midsole 40 would have a recess (not shown) rather than through opening 44 for receiving insert 100. In some instances, midsole 40 may have a rim (see rim 430 in FIG. 7) and foot portion 104 may be continuous or contiguous and generally flush with rim (430), as illustrated by FIG. 7. Upper 20 would then be connected to rim (430) and foot portion 104. Alternatively, upper 20 can be connected to outside vertical surface 130, with or without rim (430). Flanges 150 and 160 may be omitted if they are not needed to connect resilient insert 100 to a shoe 10. Alternatively, flanges could be provided in other places on insert 100 for stitching, bonding or otherwise connecting insert 100 to a shoe 10. For example, a flange may be provided on foot portion 104 for stitching or bonding of foot portion 104 to upper 20. A flange could be provided on the periphery of foot portion 104 for attaching upper 20 so as to expose outside surface 130 and inside surface 140 of foot portion 104. Regarding channels 122 and 124, one or more of the channels in foot portion 104 may extend entirely to upper edge 180 (not shown). Further, it will be appreciated that nozzle 170 may be omitted if the desired pressure is sealed inside the insert during manufacturing.

Figure 8:
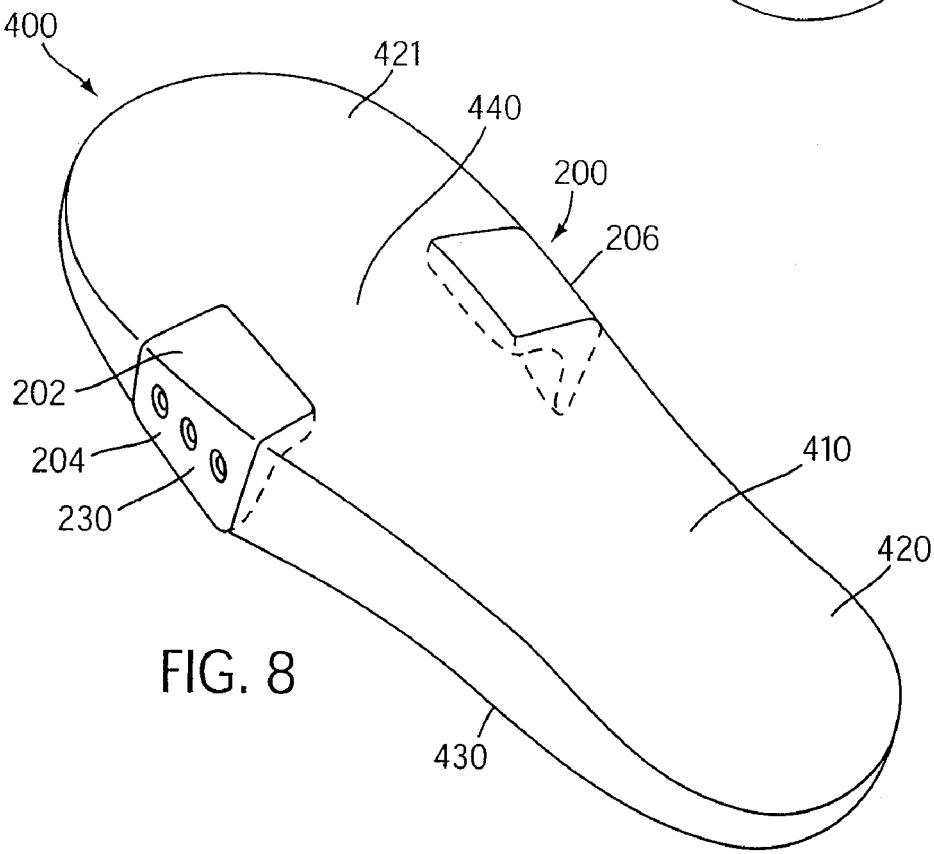
FIG. 8 is a perspective view of the bottom side of the device of FIG. 7.

In the embodiments of FIGS. 7 and 8, a midsole 400 receives a resilient insert 200 of dynamic lateral stability device, the insert having upstanding foot portions 204 and 208 on respective lateral and medial sides of the foot. Resilient insert 200 comprises a first L-shaped element 200A and an opposing second L-shaped element 200B. First L-shaped element 200A is defined by a horizontal first portion 202 and vertical second portion 204. Opposing second L-shaped element 200B is defined by a horizontal third portion 206 and a vertical fourth portion 208. Similar to the previous embodiment, the horizontal portions are referred to as sole portions and the vertical portions are referred to as foot portions. The portions are comprised of a plurality of surfaces as described in the previous embodiment.

Resilient insert 200 further includes a bridge 290 that spans a distance between the two L-shaped elements. Bridge 290 is thinner than the horizontal foot portions 202 and 206 and is preferably fluidly independent from the L-shaped elements. The function of the bridge is to cushion the foot and provide a connecting structure for the opposing L-shaped elements to form a single unit. An additional resilient pad 295 may be provided for cushioning, and may include sectional pads 295*a*, 295*b* and 295*c* in fluid communication with each other and which tend to permit flexure of the resilient insert 200.

Resilient insert 200 may include contacts 225. As in the first embodiment, the term contact is used to designate a region where opposing bladder surfaces contact each other by weld, or other means and may include through-holes for breathability.

As shown in FIG. 7, resilient insert 200 is received in an opening 445 in midsole 400. Midsole 400 includes a rear section 420 that extends from the heel to an edge of the metatarsal region and a forward section 421 that extends from the toes to an opposing edge of the metatarsal region. In between rear section 420 and front section 421 is a support bridge 440, which is a part of recessed portion 441 of midsole 400. Support bridge 440 provides support for resilient insert bridge 290 and additional resilient pad 295. Adjacent to the lateral and medial edges of support bridge 440 are openings 442 and 444. The openings receive sole portions 202 and 206 of respective L-shaped elements 200A and 220B. FIG. 8 (with partial hidden lines) illustrates a bottom 410 of midsole 400 exposing bottom surfaces of sole portions 202 and 206.

Midsole 400 includes an upstanding rim 430. In assembly, rim 430 is continuous with vertical portions 204 and 208, such that, rim 430 flanks vertical portions 204 and 208. Similar to the embodiment of FIG. 6, outside vertical surface 230 and 231 are generally contiguous with an outer side surface of midsole 400 and are visibly exposed to the exterior of the shoe. An upper is connected to an inner wall of the rim 430 and the inner surfaces of vertical portions 204 and 208.

It will be appreciated that bridge 290 can be in fluid communication with one or more of the L-shaped elements, or that the bridge may be formed of foam as opposed to a bladder manufacture. Further, each of the sectional pads can be in fluid communication with all or a part of the remainder of the resilient insert 200. As described in the previous embodiments, resilient insert 200 may include channels (not shown, but see channels 122 and 124 in FIG. 2) for improving flexibility, especially for a heel-to-toe forward motion, or may include some combination of channels and contacts 225 for flexibility and structural integrity. In an alternative, an outsole could have openings for exposing a bottom surface of the sole portions to an exterior of the shoe. Also, flanges may be provided on the foot portion for connecting the upper and/or midsole to the device.

In operation, the resilient insert 200 of the dynamic lateral stability device embodiment of FIGS. 7-8 is positioned in a midsole as a single unit. The horizontal sole portions of the insert are located generally underneath the foot and the vertical foot portions are located adjacent opposing lateral edges of the foot. The vertical foot portions function as bumper-like lateral and medial sidewalls that vary in stiffness with loading and unloading of the adjacent horizontal sole portion. As a load increases on a horizontal sole portion, the adjacent vertical foot portion becomes an increasingly stiffer bumper-like sidewall. When the sole portion is loaded from a wearer's foot, the bumper-like sidewall absorbs lateral impacting forces and aids in preventing the foot from rolling-over the edge of the shoe.

Figure 9:
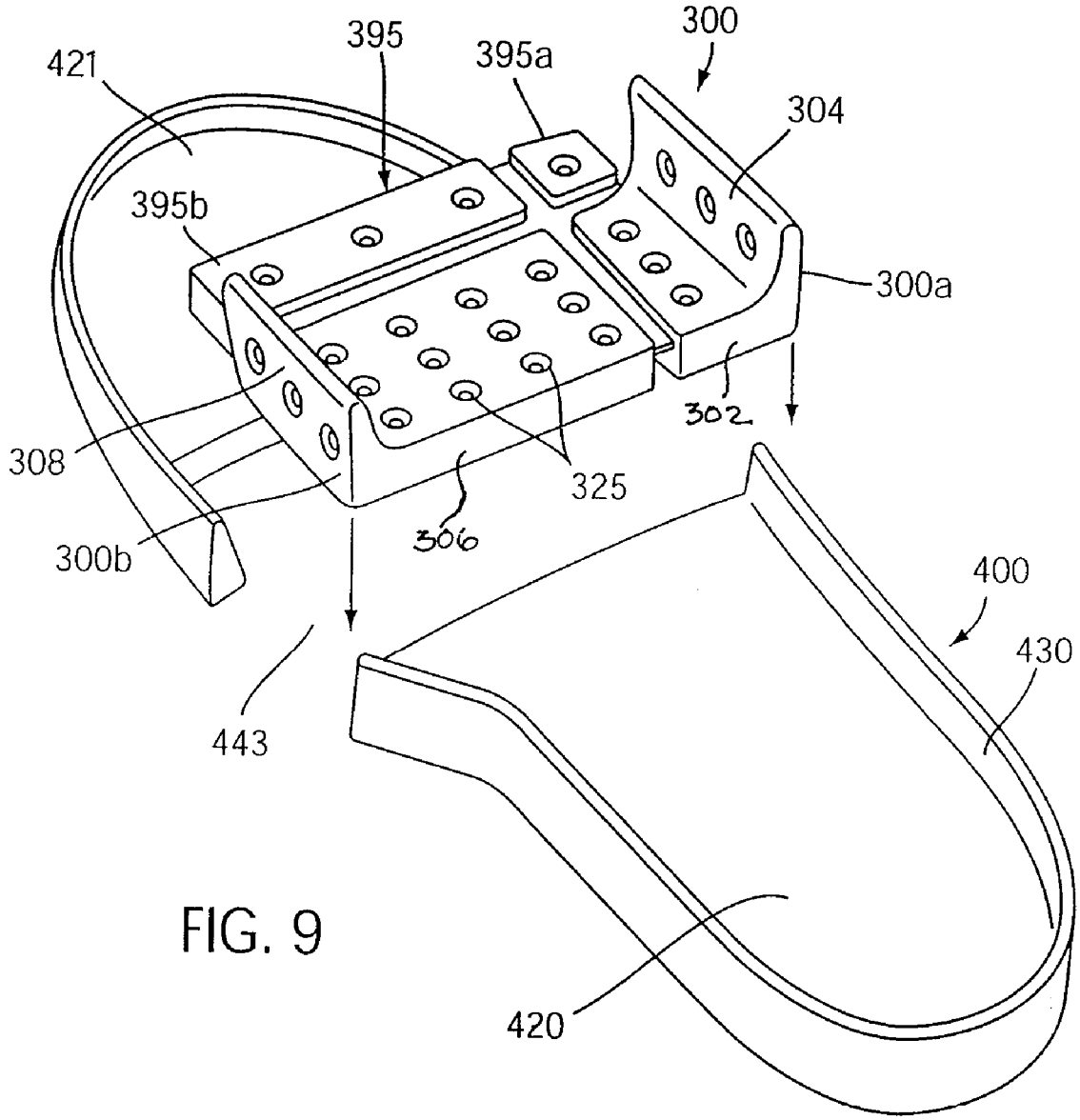
FIG. 9 is an exploded perspective view of another embodiment resilient bladder insert of the dynamic lateral stability device shown with a sole member for a left foot.

FIG. 9 shows another embodiment of the dynamic lateral stability device. The device comprises a resilient insert 300 having a first L-shape element 300A fluidly independent from an opposing second L-shaped element 300B that has an elongate sole portion. The difference between this embodiment and that shown in FIGS. 7-8 is that the separate, central cushioning bridge is eliminated and the elongated sole portion of at least one of the first or second L-shaped elements 300A, B underlies a greater portion of the wearer's foot.

Resilient insert 300 may include an additional cushioning pad 395. Cushioning pad 395 includes delineated portions 395*a* and 395*b* in fluid communication with each other. Cushioning pad 395 provides additional cushioning and the delineation of portions imparts flexibility to the resilient insert. Resilient insert 300 may further include contacts 325 for increasing the structural integrity of the insert and preventing uncontrolled or excessive surface bulging.

In assembly, resilient insert 300 is received by an opening 443 in midsole 400. As in the previous embodiment, the midsole includes a rear section 420 that extends from the heel to an edge of the metatarsal region, and a forward section 421 that extends from the toes to an opposing edge of the metatarsal region. In between rear section 420 and forward section 421 is opening 443 which may be located in the forefoot region. The bottom of midsole 400 may expose resilient insert 300.

Midsole 400 may include a rim 430. In assembly, the rim is continuous or contiguous with the foot portions 304 and 308. Similar to the embodiment depicted in FIG. 6 or 8, outside surfaces of the first and second foot portions may be visibly exposed to the exterior of the shoe. An upper may be connected to an inner wall of the rim 430 and an inner surface of foot portions 304 and 308.

Similar to the previous embodiment, it will be appreciated that the L-shaped elements can be fluidly independent or in fluid communication. Further, the additional cushioning pad 395 may be in fluid communication with all or a part of the remainder of resilient insert 300. Resilient insert 300 may also include channels for improving flexibility, especially for a heel-to-toe forward motion (not shown). Still further, the outsole may have an opening for exposing resilient insert 300 to an exterior of the footwear, in which case the bottom surface of sole portions 302 and 306 would preferably be substantially co-planar with the outsole. Exposing the resilient insert in this manner may be aesthetically appealing and reduces the weight of the shoe by reducing the amount midsole and outsole material. The upper may be connected to the inside, outside, or periphery of foot portions 304 and 308 and one or more flanges (not shown) may be provided for connecting insert 300 to a shoe.

The operation of the dynamic lateral stability device embodiment of FIG. 9 is similar to the operation of the device of FIGS. 7-8. The resilient insert is positioned in a midsole as a single unit with sole portions 302 and 306 located generally underneath the foot and foot portions 304 and 308 located adjacent respective lateral and medial side edges of the foot. Each foot portion 304 and 308 varies in stiffness with loading and unloading of the respective sole portion 304 and 308. When foot portions 304 and 308 are adjacent side edges of a wearer's foot, the foot portions absorb lateral impacting forces and aid in preventing the foot from rolling-over the edge of the shoe.

The lateral stability device embodiments illustrated in FIGS. 10-25B include a means for compensating for an increase in internal volume of an article of footwear due to compression of a sole assembly by substantially simultaneously decreasing the internal volume. The benefit of the compensating means is that the volume of the footwear does not substantially change and thus the original snug fit of the footwear is not lost during compression loading of the sole assembly.

The embodiments of FIGS. 10-25B include a dynamic lateral stability device which comprises a resilient insert that is filled with a fluid, preferably a gas at a low or ambient pressure. The gas is as described in the previous embodiments. Also similar to the previous embodiments, the lateral stability device is adapted to be assembled in a shoe proximal to the lateral or medial metatarsal regions to provide optimal cushioning response and dynamic stabilization. The embodiments each include a cushioning horizontal sole portion and a supporting vertical foot portion that wraps around at least a portion of the lateral side of the wearer's foot. The vertical foot portion may comprise resilient, finger-shaped elements which may be connected to material of the shoe upper. The finger-shaped elements are in fluid communication with the horizontal sole portion of the device so that the application of a compressive load on the horizontal sole portion results in an increase in pressure in the vertical foot portion. Various additional structural features are contemplated with the finger-shaped elements in order to enhance the stability aspect of the device by providing a dynamic tightening around the wearer's foot in response to a compressive load. Tightening the upper around the wearer's foot accomplishes the objective of helping to keep the foot on the footbed and helping to maintain the foot in a substantially parallel relation to the ground thereby reducing the tendency of the foot to roll over.

In FIGS. 10-16, the dynamic lateral stability device includes a resilient insert 500 with a cushioning sole portion 502 and a wrapping foot portion 504 comprised of one or more finger-shaped elements 504(*a-c*). The finger-shaped elements cradle a foot and may follow a contour of the footwear in which resilient insert 500 is incorporated.

Figure 14:
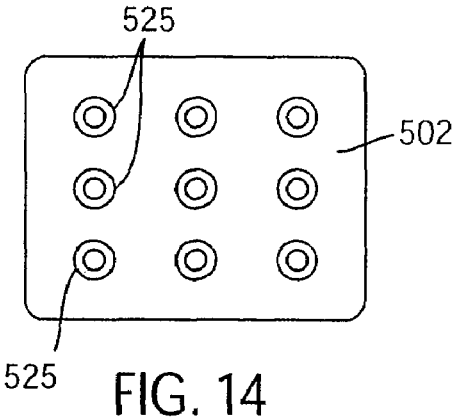
FIG. 14 is a bottom plan view of the insert of FIG. 10.
Figure 15:
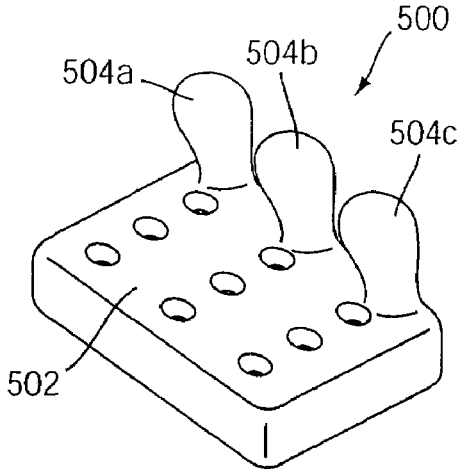
FIG. 15 is a perspective view of the insert of FIG. 10.

As shown in FIG. 14, the sole portion of insert 500 may include at least one contact 525 which help the sole portion of the insert to maintain structural stability and shape throughout the useful life of the shoe. The at least one contact 525 also serves to reduce the volume of the sole portion thereby helping ensure that pressure does not dissipate without causing an appreciable increase in fluid pressure in the foot portion.

The volume of sole portion 502 may be about 20-100 c.c. (cubic centimeters), and preferably about 25 c.c. An appreciable pressure increase in the finger-shaped elements occurs when sole portion 502 is compressed by about ten percent (10%), and more noticeable when compressed by about thirty-three percent (33%) or more. As with previous embodiments, the increase in pressure in the foot portion is caused by compressive load on the sole portion. As the loads increase on the sole portion, the foot portion becomes increasingly stiffer. The pressure and therefore the stiffness of the foot portion dynamically change with loading and unloading of the sole portion. Additionally, the finger-shaped elements can be specially designed to expand in select directions for helping to maintain the foot on the footbed. As finger-shaped elements 504 expand under increasing pressure the fingers push on the lateral and/or medial sides of the foot. The counter-force created by the expanding finger-shaped elements counteracts the foot's sideways force and further helps push the foot back into positional contact with the footbed thereby aiding to prevent foot roll over.

The expansion of the finger-shaped elements also causes the volume of the shoe particularly in the toe-box region of the shoe to decrease, which helps maintain positional contact of the foot with the footbed. When loaded, the midsole and the sole portion incorporated therein depress in height as the wearer's foot, after the shoe makes contact with the ground, presses closer to the ground surface causing an increase in the internal volume of the shoe. The increase in internal volume is due to the compression of the midsole distancing it from the upper. The increase in volume, particularly in the toe-box region of the shoe undesirably allows the foot to float or swim within the shoe. By providing a compensating means which includes finger-shaped elements that expand, some if not all of the increased volume is taken-up or compensated for and the shoe maintains tightness for holding the foot on the footbed.

Figure 16:
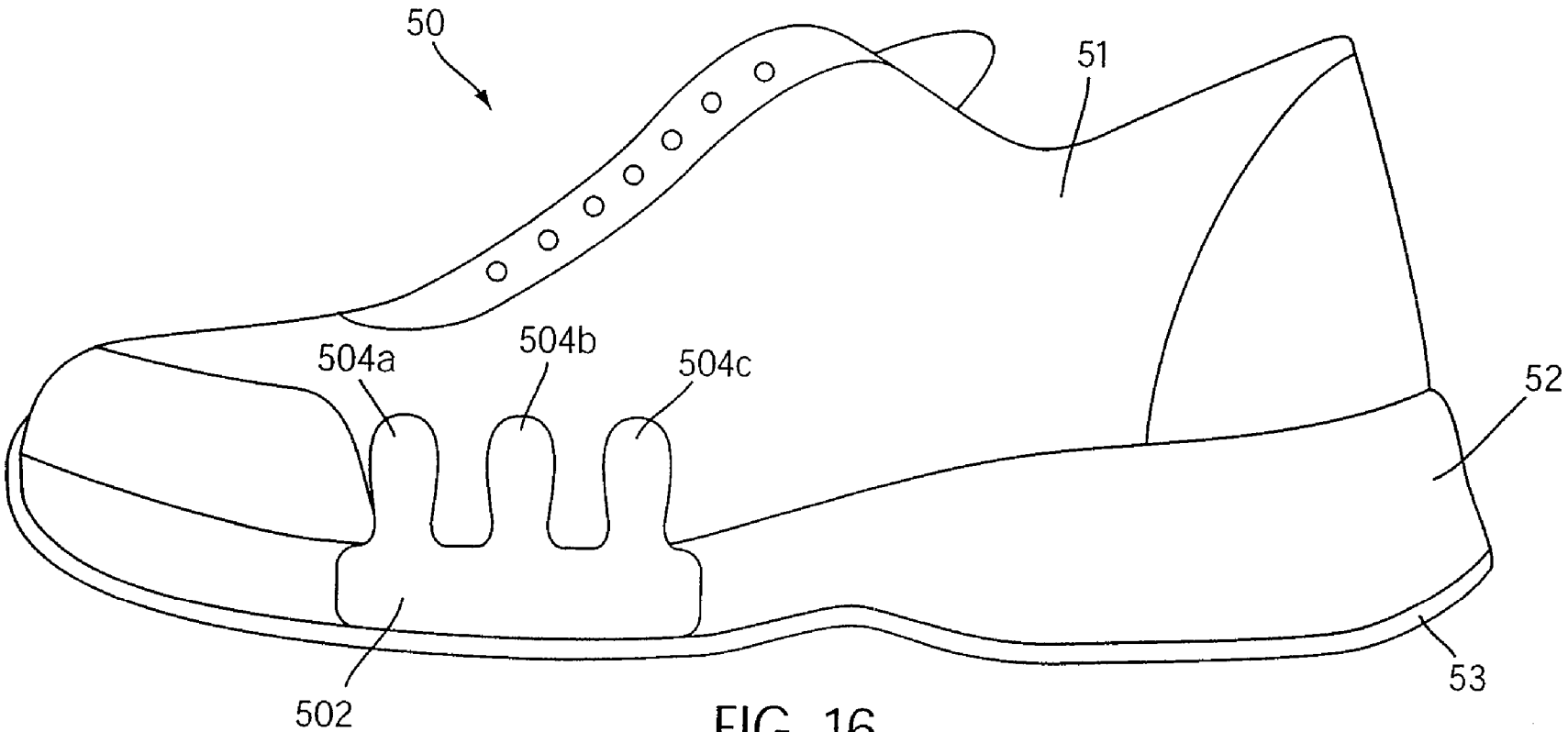
FIG. 16 is a side view of a shoe with the insert of FIG. 10.

FIG. 16 shows the resilient insert 500 of FIGS. 10-15 assembled into a shoe. Shoe 50 includes an upper 51, a midsole 52, and an outsole 53. Resilient insert 500 is incorporated within midsole 52 and upper 51 on the lateral side of the foot, adjacent the fifth metatarsal head. As in previous embodiments, the insert 500 is disposed in an opening in midsole 52. Upper 51 may be connected to finger-shaped elements 504 (*a-c*), such that, the finger-shaped elements are exposed on the exterior of the shoe.

Finger-shaped elements 504(*a-c*) are fixedly connected to upper 51 such that an increase in pressure in the finger-shaped elements causes the finger-shaped elements to stiffen and provide a firmer wall for resisting roll over and causes finger-shaped elements to expand for tightening the fit of upper 51 around the wearer's foot. Tightening the fit of the upper enhances the foot's contact with the footbed and helps to ensure that the foot remains stable on the shoe platform. The firmer wall and the tightened fit contribute to the dynamic stability response of the shoe to quick cutting movements.

The properties of the materials used for upper 51 also play a part in the tightening response. By using a stretch material in a strategic manner, upper 51 can be made flexible and elastic in a longitudinal direction for comfort, and substantially inelastic in a lateral direction across the foot in order to enhance the tightening of the upper in response to a compressive load on sole portion 502 of dynamic lateral stability device 500.

Figure 10:
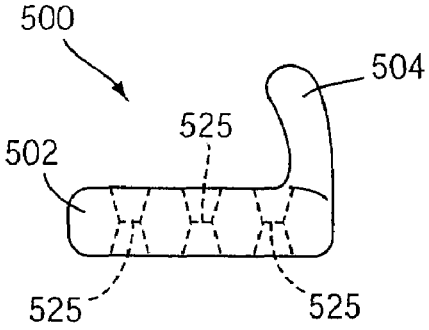
FIG. 10 is an end view of an embodiment of the resilient insert of the dynamic lateral stability device, the insert having with finger portions.
Figure 11:
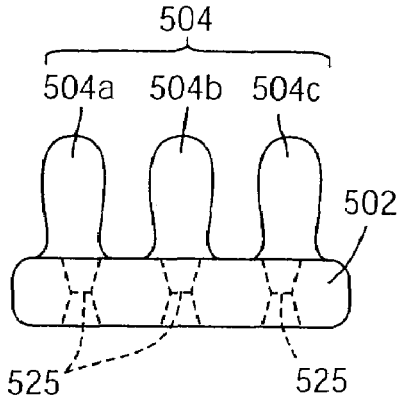
FIG. 11 is a side view of the insert of FIG. 10.
Figure 12:
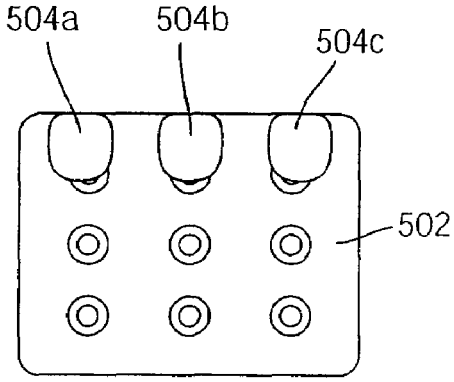
FIG. 12 is a top plan view of the insert of FIG. 10.
Figure 13:
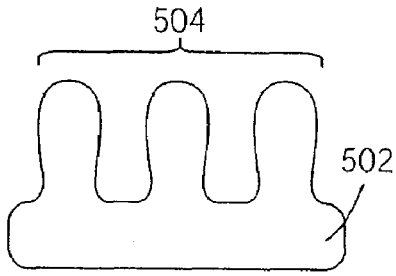
FIG. 13 is an opposing side view of the insert of FIG. 10.
Figure 17:
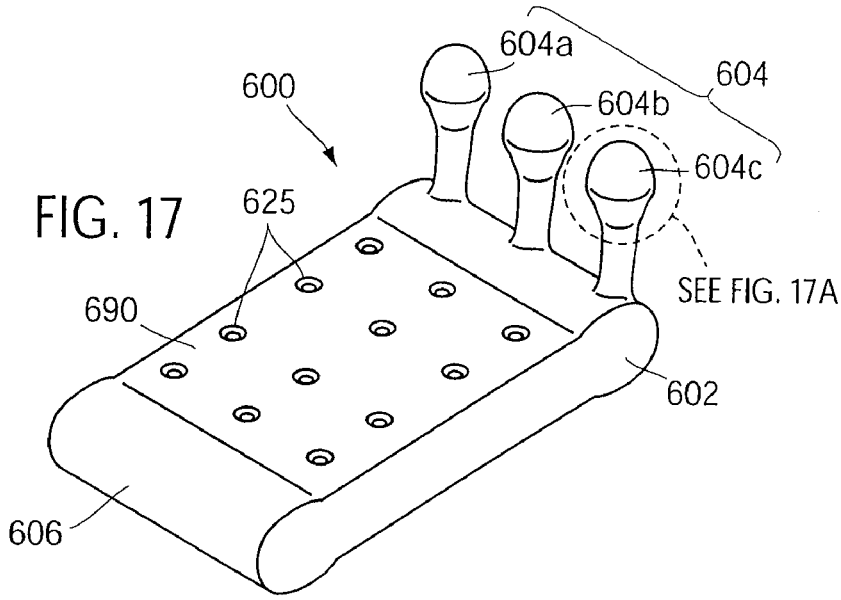
FIG. 17 is a perspective view of another resilient insert of the dynamic lateral stability device with finger portions.

It will be appreciated that the fingers may be curved as shown in FIG. 10, or more straight as suggested in FIG. 17. Further, the sole portion can include through-holes for breathability, structural integrity of the insert and prevention of excessive bulging in response to pressure increases. Sole portion 502 may also include channels for structural stability and flexibility. As in the previous embodiments, channels and contacts further serve to decrease the volume of the sole portion and thus prevent pressure from dissipating without causing an appreciable increase in fluid pressure in finger-shaped elements 504(*a-c*).

It will further be appreciated that resilient insert 500 may be positioned adjacent a medial side of the foot, proximate the first metatarsal. The insert can be positioned in the midsole during or after formation of the midsole, or during assembly of the other components of the shoe. Finger-shaped elements 504(*a-c*) can be partially or wholly exposed to the wearer's foot or incorporated in between material layers of the upper to function in a hidden or partially hidden configuration. The finger-shaped elements may be layered between a mesh material or a see-through material to exposed the elements to an interior or an exterior of a shoe. Flanges (see flanges 611 in FIG. 17A) may be provided on the fingers elements to facilitate connection with an upper material.

FIGS. 17 and 17A-C show another embodiment of the resilient insert of the dynamic lateral stability device, the insert having finger-like elements 604(*a-c*) of a different shape and a cushioning for underneath a foot, which has a plurality of sections 602, 690, and 606. The lateral stability device includes resilient insert 600 having a first sole portion 602 and a foot portion 604 extending upwardly from the sole portion. Resilient insert 600 further includes a second sole portion 606 located opposite first sole portion 602, and a cushioning pad 690 therebetween. Sole portion 606 improves lateral (or medial) support opposite the foot portion 604 due to its higher profile as compared to cushioning pad 690.

Cushioning pad 690 can include contacts 625 for imparting structural integrity to cushioning pad 690. Cushioning pad 690 is fluidly independent of sole portion 602 since a lower ratio of volumes between sole portion 602 and foot portion 604 is desirable to ensure that pressure due to compression of sole portion 602 is transferred to foot portion 604. If the volume of sole portion 602 is too large, an increased fluid pressure due to a compression force on a small area of sole portion 602 may dissipate without causing the desired appreciable increase in fluid pressure in foot portion 604.

Figure 17A:
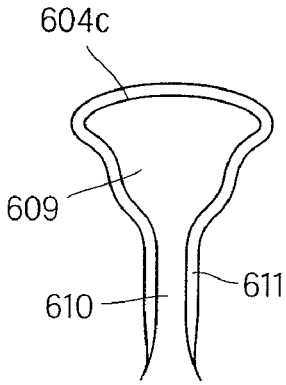
FIG. 17A is an enlarged detailed view the finger portion indicated in area A in FIG. 17.

FIG. 17 shows foot portion 604 comprising a plurality of protrusions or finger-shaped elements 604*a*, 604*b*, and 604*c*. FIG. 17A shows an enlarged view of one finger-shaped element 604*c*. The finger-shaped element can include a bulbous section 609, a stem section 610, and a flange 611 (not shown in FIG. 17 for clarity). The stem section 610 connects bulbous section 609 to sole portion 602 and the flange 611 connects the finger to an upper, such as by stitching or bonding.

Figure 17B:
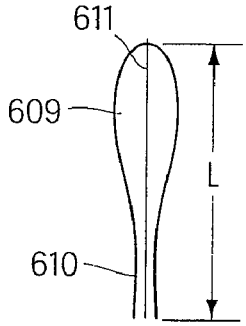
FIG. 17B is side view the finger portion of FIG. 17A.
Figure 17C:
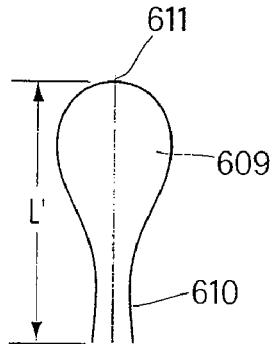
FIG. 17C is side view of the finger portion of FIG. 17A in an expanded state.

FIG. 17B shows a side view of finger 604*c* in a substantially uncompressed or unloaded pressure state, where the bulbous section 609 is somewhat flat and elongate. Upon loading sole portion 602, fluid therein is transferred through stem section 610 to bulbous section 609 thereby dynamically increasing fluid pressure in the bulbous section causing the bulbous section to expand and enlarge outward. The bulbous section experiences a greater expansion than the stem section 610 due to a greater surface area. The outward expansion causes the length of the protrusion to decrease, as illustrated in FIGS. 17B and 17C. In an unloaded state, the length line L is greater than length line L' in the loaded state. Expansion of the bulbous section may be analogous to super inflation of a football from a normal, elongate shape to a rounded state, where the sides expand outward and the ends of the football draw inward closer together.

The change in pressure of bulbous section 609 is important to helping keep the foot in contact with the footbed. At least four consequences occur when pressure increases in the bulbous section: 1) the finger-shaped elements become dynamically stiffer forming a bumper-like wall that can absorb sudden and impacting lateral forces; 2) expansion of the bulbous section creates a counter-force for pushing the foot back onto the footbed; 3) expansion of the bulbous section decreases the volume of the shoe further helping to hold the foot on the footbed; and 4) the decrease in length of the bulbous section tightens the upper by bringing the upper closer to the footbed. The expansion and the tightening serving in part as a means compensating for an increase in internal volume of the shoe that is due to compression of the sole.

In an assembled shoe 60, foot portion 604 extends generally perpendicular to first sole portion 602. Foot portion 604 is preferably positioned adjacent to the fifth metatarsal head on the lateral side of the foot. For medial stability, foot portion 604 is positioned on a medial side of the foot near the first metatarsal.

Figure 18:
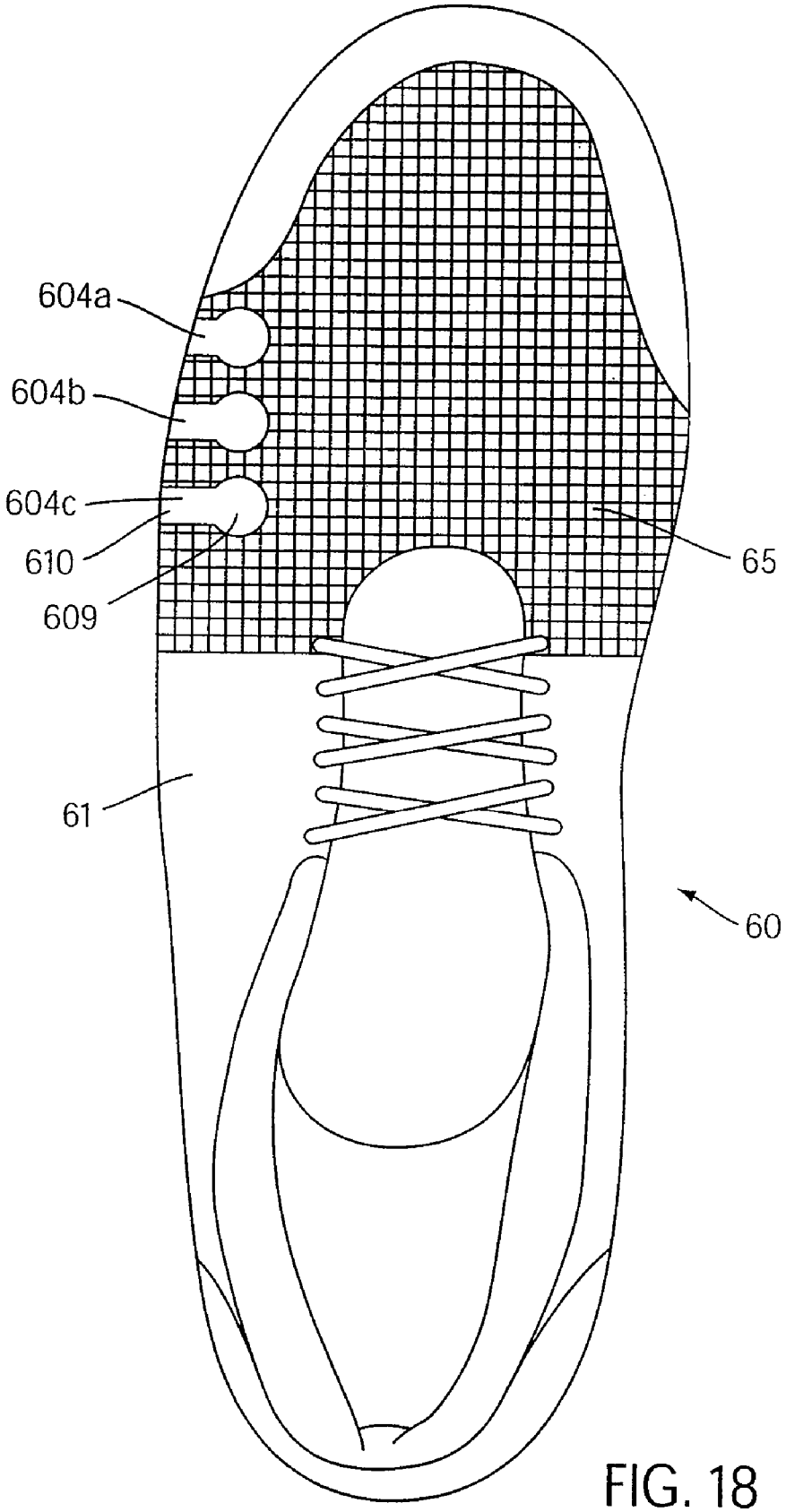
FIG. 18 is a plan view of a left shoe with the insert of FIG. 17.

FIG. 18 shows the resilient insert 600 assembled in a shoe 60 having a vamp 65 made of a material that is substantially inelastic in a lateral direction with respect to the shoe 60. Foot portion, finger-shaped elements 604(*a-c*) are shown exposed to an exterior of the shoe. The finger-shaped elements are connected to vamp 65, such as, by adhering or stitching flanges 611 to vamp 65. The finger-shaped elements can curve about the lateral (or medial) side of the shoe and foot therein. As discussed above, finger-shaped elements 604(*a-c*) contract in length when subject to an increase in internal fluid pressure. Since vamp 65 is substantially inelastic in the lateral direction, the contraction of finger-shaped 604(*a-c*) elements causes vamp 65 to tighten about the wearer's foot helping compensate for increases in internal volume of the shoe and thus helping keep the foot snuggly on the footbed.

Figure 19:
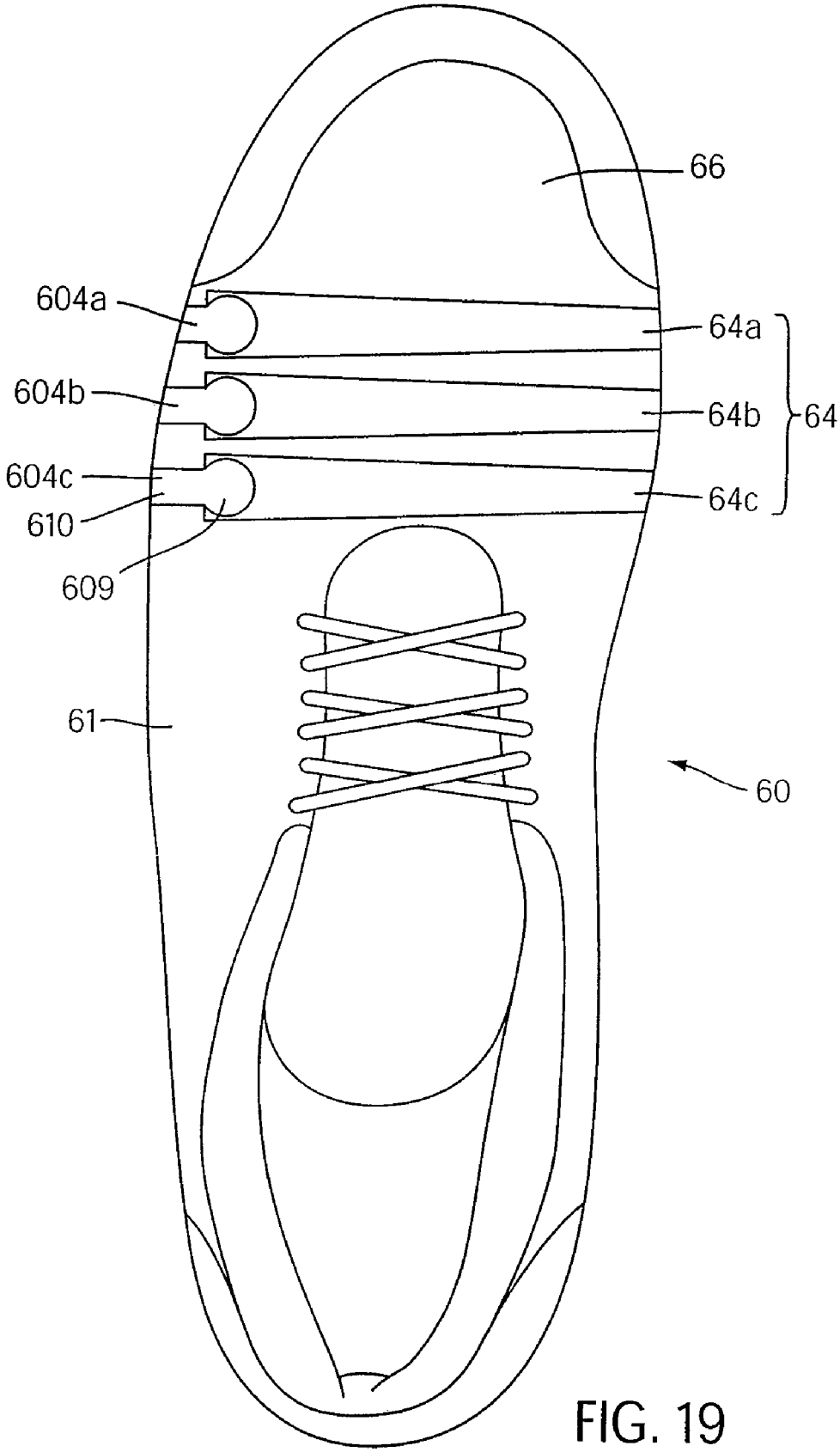
FIG. 19 is a plan view of another left shoe incorporating the insert of FIG. 17.

FIG. 19 shows another shoe 60 incorporating the present dynamic lateral stability device. The shoe 60 has a strap 64 connected to finger-shaped elements 604(*a-c*) of resilient insert 600. Strap feature 64 can comprise a plurality of straps 64(*a-c*) that extend from respective finger-shaped elements 604(*a-c*) to an opposing side of shoe 60. Finger-shaped elements 604(*a-c*) may be connected to strap 64 by adhesive or stitching or other appropriate means. Strap 64 preferably includes a material that does not permit stretching in at least the lateral direction of shoe 60. When bulbous sections 609 expands in response to a quick compressive load pressure on sole portion 602, the pressure dynamically increases in finger-shaped elements 604(*a-c*) causing finger-shaped elements 604(*a-c*) to contract in length and consequently tighten straps 64(*a-c*) across the top of the wearer's foot serving to help hold the foot on the footbed. In addition to tightening of straps 64(*a-c*), the volume of shoe 60 decreases due to the finger-shaped elements 604(*a-c*) expanding, which tends to compensate for an increase in volume due to load compression of the sole and thus tends to hold the foot on the footbed. Further, an increase in pressure in finger-shaped elements 604(*a-c*) stiffens the finger-shaped elements 604(*a-c*) making a lateral bumper for the wearer's foot. Vamp 66 can be permitted to stretch in the lateral direction and particularly the longitudinal direction with respect to the shoe for permitting flexibility.

Foot portion 604, while illustrated as straight, may be curved to conform to a portion of the foot and/or upper 61. First sole portion 602 and second sole portion 606 may be curved to conform to a longitudinal direction curvature of shoe 60. Further, a finger-shaped element 604(*a-c*) may have a different size as compared to another finger-shaped element.

Cushioning pad 690 having at least one contact 625 can include at least one through-hole for breathability, channels for flexibility and stability, or any combination thereof. Since cushioning pad 690 is a separate chamber, a foam pad could be used instead of a fluid filled chamber. If high pressure, compression loading of resilient insert 600 is anticipated from jumping activities, for example, it may justify making cushioning pad 690 in fluid communication with sole portions 602 and 606 and/or foot portion 604. Higher compression loads tend to compress a greater percentage of cushioning pad 690 and sole portions 602 and 606 located underneath the foot, such that, pressure dissipation is less of a factor in providing sufficient pressure to foot portion 604.

It will further be appreciated that the geometry of the finger-shaped elements 604(*a-c*) can be modified to strategically position the expansion and contraction of the finger-shaped elements. A finger-shaped element having a larger bulb that expands a greater degree and contracts a great degree could be positioned toward a rear of the lateral or medial metatarsal head, where a smaller bulb could be located toward a toe portion of a foot for strategically positioning a greater tightening effect near the widest portion of the foot. Further, materials for the upper can be selected based on desired expansion and contraction to control the tightening of the upper around the foot. While FIGS. 18 and 19 show finger-shaped elements 604(*a-c*) exposed to the exterior of the shoe, the finger-shaped elements may be interiorly positioned within the upper, or between layers of the upper, or partially exposed when the layers are mesh, for example. Similarly, at least one of straps 64(*a-c*) can be interiorly positioned within upper 61 or positioned between material layers of upper 61. Straps 64(*a-c*) may be attached diagonally rather than substantially lateral across the foot from the finger-shaped elements 604(*a-c*), and/or straps 64(*a-c*) could have a unifying structure that unites two or more of the straps along a length thereof.

Figure 20:
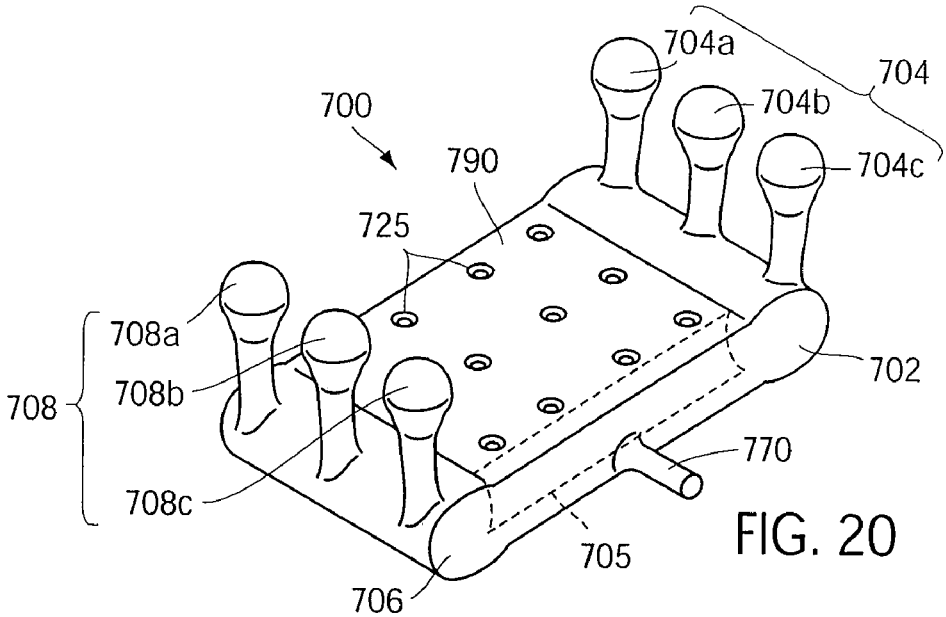
FIG. 20 is a perspective view of an embodiment of a resilient insert of the dynamic lateral stability with finger portions along two sides.

FIG. 20 shows another embodiment of resilient insert 700 of the dynamic lateral stability device having a lateral foot portion 704 and a medial foot portion 708 connected in an assembly unit for providing both lateral and medial foot support. Resilient insert 700 is preferably a bladder including a first sole portion 702 and a second sole portion 706. Foot portions 704 and 708 extend generally perpendicular to respective first and second sole portions. A conduit 705 can connect first sole portion 702 and second sole portion 706 in fluid communication. A nozzle 770 is connected to conduit 705 for adding or subtracting fluid pressure to the sole portions.

In between first and second sole portions 702 and 706 is a cushioning pad 790. As in the previous embodiment, cushioning pad 790 can be a separate bladder fluidly independent of the sole portions and has at least one contact 725.

Foot portion 704 can include a plurality of protrusions or fingers-like elements 704(*a-c*), and foot portion 708 may include a corresponding plurality of protrusions or fingers-like elements 708(*a-c*).

As in previous embodiments, finger-like elements 704(*a-c*) may be straight or curved for conforming to a foot and/or an upper. Further, a finger-shaped element 704(*a-c*) may have different sizes compared to another finger-shaped element. Still further, the foot portion 704 or finger-shaped elements 704(*a-c*) on a lateral side of a foot may be larger than the foot portion or finger-shaped elements on the medial side, or visa versa, for providing more support to one side of the wearer's foot. The sole portions 702 and 706 may be curved to conform to a foot or a midsole. In an alternative, cushioning pad 790 can be in fluid communication with one or more of the sole portions if the expected compression loads are great enough to overcome undesirable pressure dissipation. Alternatively, foam or other cushioning may be substituted for the bladder cushioning pad 790. Cushioning pad 790 is shown as having contacts 725 may include channels for flexibility, through-holes for breathability, or any combination thereof.

Figure 21:
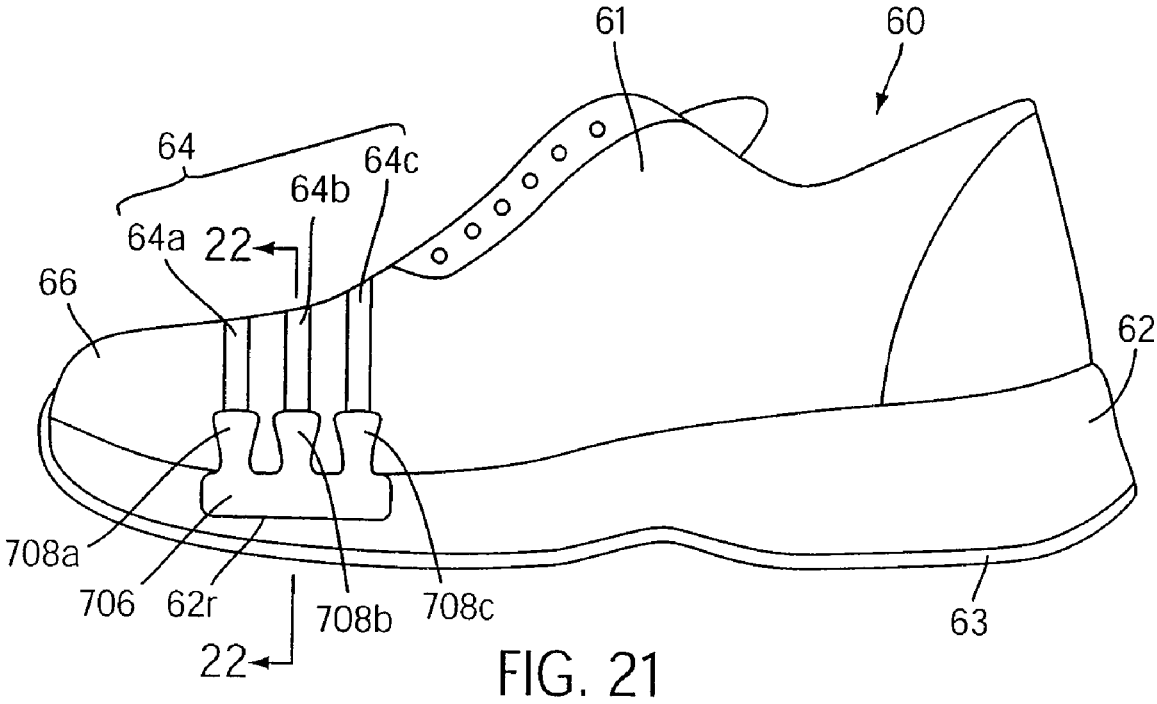
FIG. 21 is a side view of a left shoe incorporating the insert of FIG. 20.
Figure 22:
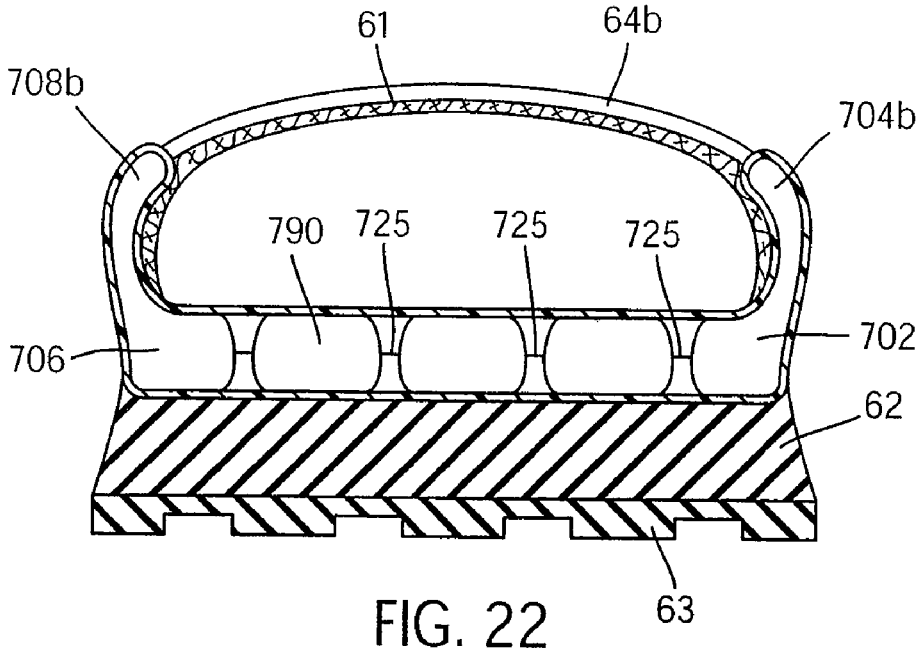
FIG. 22 is a cross-sectional end view of the shoe taken along line 22-22 of FIG. 21.
Figure 23A:
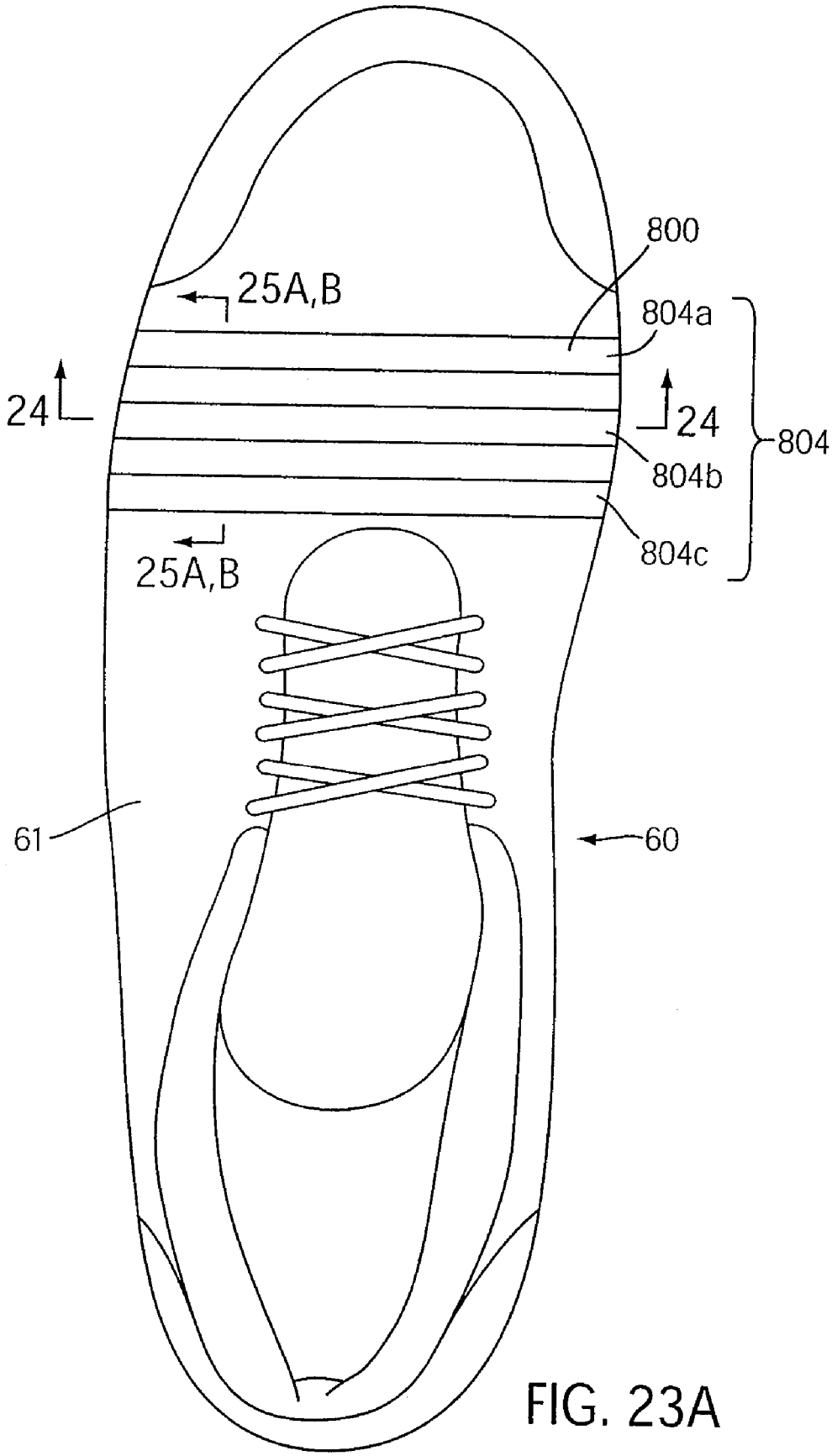
FIG. 23A is a plan view of a left shoe incorporating another embodiment of the dynamic lateral stability device.
Figure 23B:
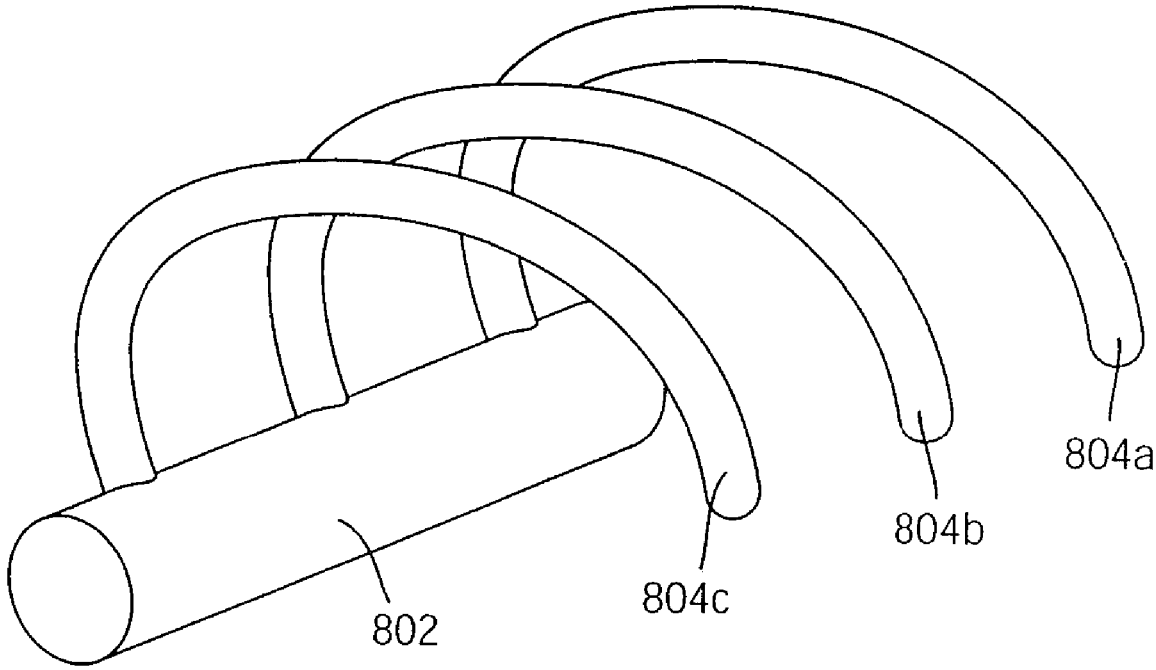
FIG. 23B is a perspective view of the insert of FIG. 23A.
Figure 24:
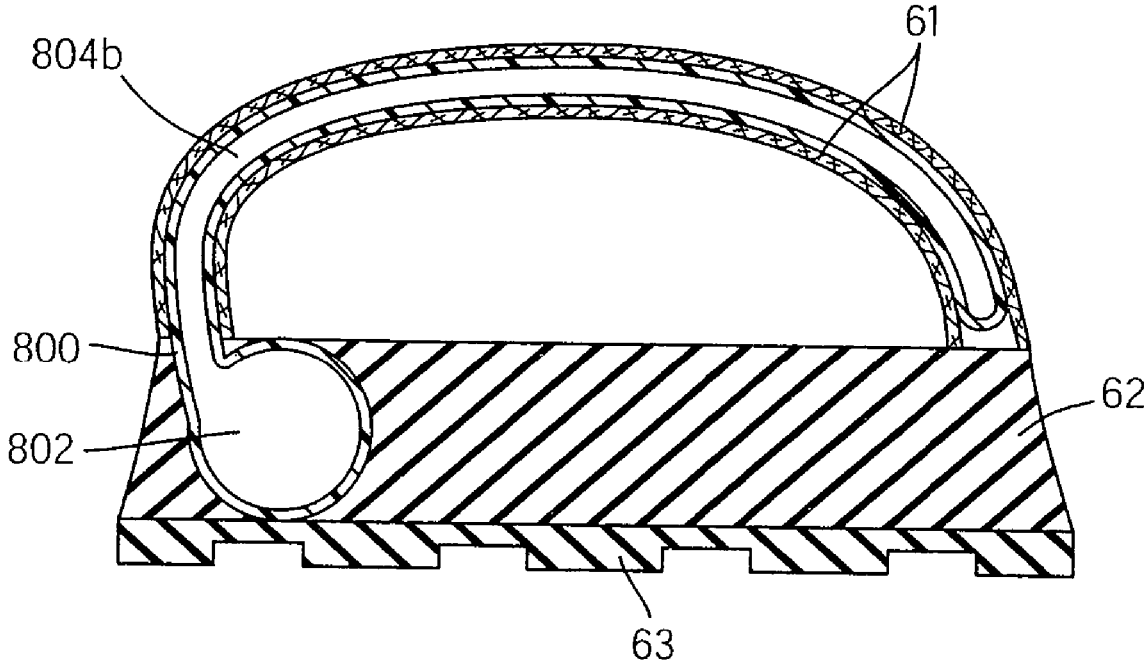
FIG. 24 is a cross-sectional end view of the shoe of FIG. 23A taken along line 24-24.

FIGS. 21-22 illustrate the resilient insert 700 in a left shoe 60 with a structural strap feature 64 for helping to hold the foot in place. Foot portion 708 is positioned proximal the first metatarsal head, and foot portion 704 is positioned proximal the fifth metatarsal for supporting both the lateral and medial sides of the foot. Shoe 60 includes an upper 61 having a vamp 66, a midsole 62 and an outsole 63. The second sole portion 706 is disposed in a recess 62*r* in midsole 62. Shoe 60 a includes strap 64 which may comprise a plurality of straps 64(*a-c*) each connected to a respective and corresponding finger-shaped element 704(*a-c*) and 708(*a-c*). Straps 64(*a-c*) span across the foot and fixedly connect to opposing finger-shaped elements. FIG. 22 shows finger-shaped element 704*b* connected to strap 64*b* that extends across upper 61 to finger-shaped element 708*b*. Straps 64(*a-c*) are made of materials that are substantially inelastic in at least the lateral direction with respect to the shoe, so that, when a finger-shaped element contracts due to a pressure increase therein, straps 64(*a-c*) tighten on the foot. Upper 61 need not be affixed to each of straps 64(*a-c*) or finger-shaped elements 704(*a-c*) or 708(*a-c*), allowing each of the straps to freely tighten in response to constriction of the finger-shaped element. In operation, tightening of the strap(s), in response to a quick compressive load, tends to reduce or compensate for increased volume due to compression of the sole and thus tends to enhances stability by helping hold the foot on the footbed and also aids in preventing the shoe upper from collapsing under a lateral force from the foot. Further, an increase in pressure in the finger elements stiffens the foot portions for providing a shock absorbing wall.

It will be appreciated that the first and second sole portions can be made fluidly independent, so that, compression of one sole portion causes a localized pressure increase in a corresponding foot portion and does not increase the pressure in the oppositely located sole and foot portions. In the shoe assembly, it will further be appreciated that the finger-shaped elements may be wholly or partially exposed to either the interior or the exterior of the shoe. Still further the finger-shaped elements may be positioned in between layers of the upper. The finger-shaped elements may be of various sizes for providing more tightening or more support on a select area of the foot. The straps can be diagonally arranged and/or the straps may be connected to each other in a unifying structure for tightening a greater surface area of the strap or the upper toward the foot.

With respect to the midsole, depending on the thickness of each of the sole portions and cushioning pad, the resilient insert may be recessed in the midsole as shown, disposed in an opening in the midsole such that bottom surfaces thereof contact the outsole, or disposed in an opening in the midsole and outsole such that a bottom surface thereof is exteriorly exposed on the bottom of the shoe.

FIGS. 23A-B, 24 and 25A-B illustrate another dynamic lateral stability device incorporated into a shoe 60; the device includes a resilient bladder insert 800 having finger-shaped elements 804(*a-c*) that extend upward from a sole portion 802 and across the foot. Shoe 60 includes an upper 61, a midsole 62 and an outsole 63. Resilient insert 800 comprises a sole portion 802 and a foot portion 804. The foot portion 804 can comprise a plurality of elongate protrusions or finger-shaped elements 804(*a-c*) which are in fluid communication with sole portion 802. Sole portion 802 is shown as located underneath a lateral side of the foot proximal the fifth metatarsal head for providing cushioning underneath the foot and translating compressive pressure to fluid pressure in foot portion 804. Foot portion 804 extends upwardly from sole portion 802, between layers of upper 61 and across the foot to a medial side of the foot. When sole portion 802 is compressed under a load, the pressure in finger-shaped elements 804(*a-c*) increases causing the finger-shaped elements to expand and tighten upper 61 of shoe 60.

Similar to the previous finger-shaped element embodiments, when the finger-shaped elements dynamically increase in pressure: 1) the finger-shaped elements become stiffer forming a bumper-like wall for absorbing sudden and impacting lateral forces; 2) expansion of the finger-shaped elements creates a counter-force for pushing the foot back onto the footbed; 3) expansion of the finger-shaped elements decreases the volume of the shoe further helping to hold the foot on the footbed; and, 4) decrease in length of the finger-shaped elements tightens the upper by bringing the upper closer to the footbed. In combination, the above provide dynamic lateral stability which aid in preventing sideways foot roll over.

Figure 25B:
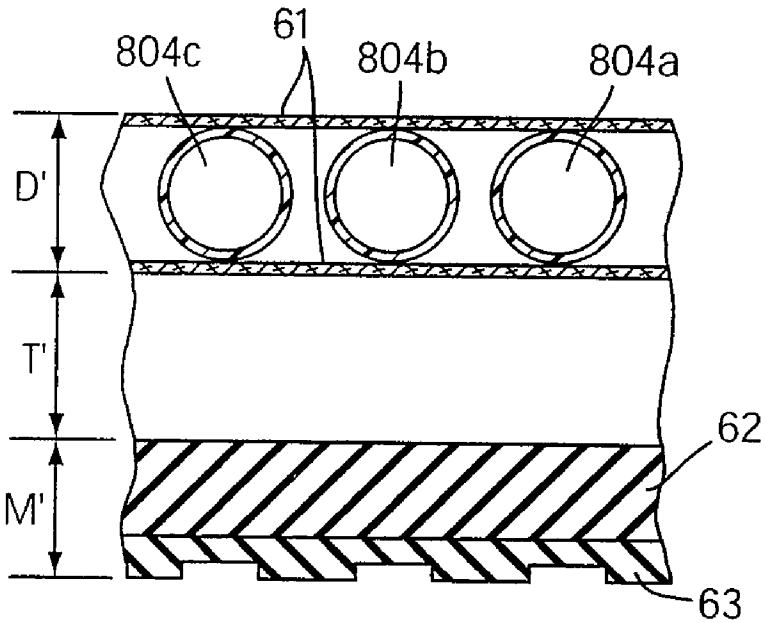
FIG. 25B is a cross-sectional view taken along line 25A, B-25A,B of a shoe in FIG. 23A showing the finger portions in a loaded state.
Figure 25A:
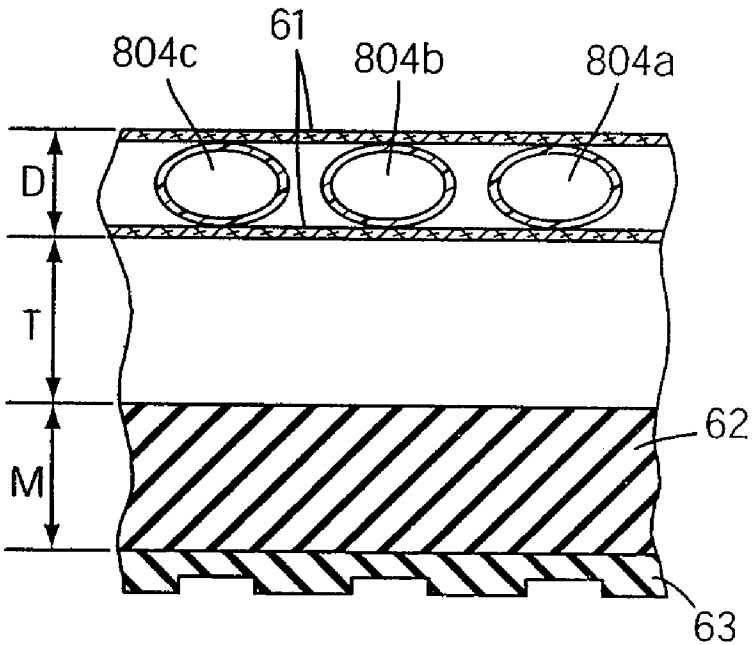
FIG. 25A is a cross-sectional view taken along line 25A, B-25A,B of the shoe in FIG. 23A showing the finger portions in an unloaded state.

FIGS. 25A and 25B illustrate the operation of protrusions or finger-shaped elements 804(*a-c*). FIG. 25A shows the finger-shaped elements 804(*a-c*) being generally elliptical in cross-section in a relaxed or unloaded state. FIG. 25B shows the finger-shaped elements in a rounded cross-section in a loaded or fully pressurized state. Finger-shaped elements 804 (*a-c*) are positioned between layers of upper 61. Underneath upper layers 61 is a toe-box region, and below that is a midsole 62 and outsole 63. In this embodiment, the height T of the toe-box region stays approximately constant. Loading pressure on midsole 62 cause midsole 62 to compress decreasing the height of midsole 62 from M to M'. But, pressure on midsole 62 also compresses sole portion 802, which causes finger-shaped elements 804(*a-c*) to expand and increase in diameter and this increases the distance between upper layers 61 from D to D'. Thus, the finger-shaped elements and upper are means for compensating for an increased internal volume because as midsole 62 decreases in height M the distance D increases tending to dynamically maintain the general height T of the toe-box.

The outer layer of upper 61 is sufficiently fixed or stiff to prevent appreciable outward expansion of upper 61. The dynamic transformation of the finger-shaped elements 804(*a-c*) from elliptical to circular cross-section in response to rapid loading on sole portion 802 results in the inner layer of upper 61 being pressed closer to the wearer's foot. In this manner, the volume size of shoe 60 does not substantially change and the original snug fit of the shoe is not lost during compression loading of midsole 62. The snug fit of the shoe helps prevent the foot from floating or swimming in the toe-box and helps maintain the foot on the footbed of the shoe, which are important to preventing sideways foot roll over.

It will be appreciated that the finger-shaped elements 804 (*a-c*) can be wholly or partially visible from the exterior of the shoe, positioned underneath the upper, or between material layers of the upper, anyone of such layers being mesh or otherwise revealing of the fingers to an interior or exterior of the shoe. The protrusions or finger-shaped elements 804(*a-c*) are shown as extending from the one side of the shoe to an opposite side of the shoe, however they may extend partially across and may be combined with a strap or vamp material that has limiting elasticity in a select direction. Finger-shaped elements 804(*a-c*) that extend across the foot may connect at their distal ends to either upper 61 or midsole 62, or be connected along their respective lengths to upper 61. A flange provided on the tip or sides of finger-shaped elements may be helpful for connecting the finger-shaped elements to the upper and/or midsole. The finger-shaped elements may be connected by adhesive, stitching or other means including fabricated channels between layers of upper 61. As in previous embodiments, the bladder portion of the insert is filled with gas, such as but not limited to, ambient air, nitrogen, other gases, or combinations thereof. Further, the pressure of the gas in the bladder in the unloaded state is as expressed above in the previous embodiments.

The foregoing description of the specific embodiments sets forth the nature of the invention that others can, by applying current knowledge, readily modify and/or adapt for various applications such specific embodiments without undue experimentation and without departing from the invention, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is of the purpose of description and not of limitation.

That which is claimed is:

1. An article of footwear comprising:

an upper that defines a void for receiving a foot; and a sole structure secured to the upper, the sole structure including a fluid-filled bladder with a sole portion and a foot portion in fluid communication with each other, the sole portion being positioned below the void, and the foot portion projecting outward from the sole portion to extend along a side of the upper and over the void, wherein the bladder includes two additional foot portions that project outward from the sole portion and extend upwards along the side of the upper and over the void.

2. The article of footwear recited in claim 1, wherein the side of the upper is a lateral side of the upper.

3. The article of footwear recited in claim 1, wherein the upper includes at least two layers of material, and the foot portion is at least partially located between the two layers.

4. The article of footwear recited in claim 1, wherein the sole structure includes a midsole, and the sole portion is encapsulated within the midsole.

5. The article of footwear recited in claim 1, wherein the sole portion is positioned in a forefoot region of the sole structure.

6. The article of footwear recited in claim 1, wherein the foot portion has a tubular configuration.

7. The article of footwear recited in claim 6, wherein the foot portion has a circular cross-section.

8. The article of footwear of recited in claim 1, wherein the foot portion has a circular cross-section.

9. The article of footwear recited in claim 1, wherein the foot portion and the additional foot portions are parallel to each other.

10. An article of footwear comprising:

an upper that defines a void for receiving a foot, the upper having (i) a medial portion that extends along a medial side of the void, (ii) a lateral portion that extends along a lateral side of the void, and (iii) an instep portion that extends over the void and between the medial portion and the lateral portion;

a sole structure secured to the upper, the sole structure including a midsole and a fluid-filled bladder, the bladder having (i) a sole portion at least partially located within the midsole, and (ii) a plurality of foot portions in fluid communication with the sole portion, the sole portion being in fluid communication with the foot portions, and each of the foot portions having an elongate configuration that projects outward from the sole portion to extend upwards along the lateral portion of the upper to extend over the void.

11. The article of footwear recited in claim 10, wherein the upper includes at least two layers of material, and the foot portions are at least partially located between the two layers.

12. The article of footwear recited in claim 10, wherein the sole portion is positioned in a forefoot region of the midsole.

13. The article of footwear recited in claim 10, wherein the foot portions have a circular cross-section.

14. The article of footwear recited in claim 10, wherein the foot portions have a tubular cross-section.

15. The article of footwear recited in claim 11, wherein the foot portions are parallel to each other.

* * * * *

UNITED STATES PATENT AND TRADEMARK OFFICE

CERTIFICATE OF CORRECTION

PATENT NO. : 7,698,835 B2
APPLICATION NO. : 12/341174
DATED : April 20, 2010
INVENTOR(S) : Daniel R. Potter et al.

It is certified that error appears in the above-identified patent and that said Letters Patent is hereby corrected as shown below:

In Column 20, Claim 15, Line 52:
Please replace "11" with --10--.

Signed and Sealed this

Thirteenth Day of July, 2010

David J. Kappos

David J. Kappos
*Director of the United States Patent and Trademark Office*